US005467725A

United States Patent [19]

Fujita et al.

[11] Patent Number: 5,467,725

[45] Date of Patent: Nov. 21, 1995

[54] THREAD SPREADING APPARATUS FOR USE IN OVERLOCK SEWING MACHINE

[75] Inventors: Shuji Fujita; Yasushi Baba; Hitoshi Itoh; Shiro Satoma, all of Tokyo, Japan

[73] Assignee: Juki Corporation, Tokyo, Japan

[21] Appl. No.: 254,887

[22] Filed: Jun. 6, 1994

[30] Foreign Application Priority Data

| | | | |
|---|---|---|---|
| Jun. 8, 1993 | [JP] | Japan | 5-137453 |
| Jun. 10, 1993 | [JP] | Japan | 5-139616 |
| Jun. 28, 1993 | [JP] | Japan | 5-157687 |
| Jun. 28, 1993 | [JP] | Japan | 5-157688 |
| Jan. 21, 1994 | [JP] | Japan | 6-004932 |

[51] Int. Cl.[6] ..... D05B 61/00; D05B 1/20

[52] U.S. Cl. ..... 112/162; 112/302; 112/163

[58] Field of Search ..... 112/162, 168, 112/269.1, 166, 163, 302

[56] References Cited

U.S. PATENT DOCUMENTS

| | | | |
|---|---|---|---|
| 3,150,622 | 9/1964 | Sigoda | 112/168 X |
| 4,267,786 | 5/1981 | Hanyu et al. | 112/163 |
| 4,343,250 | 8/1982 | Hanyu et al. | 112/163 |
| 4,546,716 | 10/1985 | Babson et al. | 112/162 |
| 4,799,439 | 1/1989 | Koshinaka et al. | 112/162 |
| 4,970,976 | 11/1990 | Kitai et al. | 112/162 |
| 5,255,622 | 10/1993 | Baba et al. | 112/168 |
| 5,269,240 | 12/1993 | Holl et al. | 112/162 |

*Primary Examiner*—C. D. Crowder
*Assistant Examiner*—Ismael Izaguirre
*Attorney, Agent, or Firm*—Tarolli, Sundheim & Covell

[57] ABSTRACT

A thread spreading apparatus for use in an overlock sewing machine capable of performing over-edge chain stitching and other stitching. The thread spreading apparatus uses a lower looper for over-edge chain stitching to allow a needle to surely drop into a triangle defined by a needle thread, a looper thread and the lower looper, thereby enabling multi-thread chain stitching and covering chain stitching to be performed without fail. The apparatus includes a thread spreading hook having hook portions with different heights for retaining needle threads and a projection formed on one of the hook portions. During stitching other than over-edge chain stitching, the hook portions of the thread spreading hook retain the needle threads when two needles drop, thereby allowing each needle to drop into a triangle defined by the looper thread, the lower looper and the corresponding needle thread. During over-edge chain stitching, the hook portions lie rearwardly of an idle chain stitch forming bore provided in a needle plate.

28 Claims, 18 Drawing Sheets

THREAD SPREADING APPARATUS FOR USE IN OVERLOCK SEWING MACHINE

BACKGROUND OF THE INVENTION

1. Field of the Invention

The present invention relates to a thread spreading apparatus for use in an overlock sewing machine. More particularly, the present invention relates to a thread spreading apparatus for use in an overlock sewing machine which is capable of performing over-edge chain stitching and other stitching (e.g., special stitching such as multi-thread chain stitching or a covering chain stitching).

2. Description of the Related Art

There has heretofore been known an overlock sewing machine which is designed to perform multi-thread chain stitching or covering chain stitching by using two vertically moving needles and a looper which oscillates both longitudinally and laterally. FIG. 32 in the accompanying drawings shows a seam of multi-thread chain stitches formed with two needles and three threads as in such an overlock sewing machine. As illustrated in the figure, two needle threads T1 and T2 extend in parallel, and a looper thread R is used for crossover stitching between the two needle threads T1 and T2.

In multi-thread chain stitching or covering chain stitching, each needle must descend into a triangle defined by a needle thread, a looper thread, and a looper. As a thread selvedge device used for this purpose, a device which forms the above-described triangle by retaining the looper thread is known as disclosed in Japanese Patent Public Disclosure (KOKAI) No. 52-12058 (1977).

However, in the case of an overlock sewing machine which is capable of over-edge chain stitching and special stitching, e.g., multi-thread chain stitching or covering chain stitching, if a lower looper for special stitching as described above is provided in addition to a pair of upper and lower loopers for over-edge chain stitching, the looper mechanism becomes complicated. Therefore, it is demanded to perform the above-described special stitching by using the lower looper for over-edge chain stitching.

In such a case, as shown in FIG. 33(A), when needles 8 and 10 descend, a lower looper 14 moves leftward (in the direction of the arrow), and hence needle threads T slide rightward relative to the lower looper 14. Therefore, each of the needles 8 and 10 undesirably drops on the left-hand side of the corresponding needle thread T and thus fails to enter the triangle defined by the needle thread T, the looper thread R and the looper 14. FIG. 33(B) shows a state where a proper triangle is formed and the needles 8 and 19 can descend into the triangle. It is necessary in order to form such a proper triangle to retain the needle threads T, not the looper thread R as in the above-described conventional technique.

SUMMARY OF THE INVENTION

Accordingly, it is an object of the present invention to provide a thread spreading apparatus for forming the above triangle by the lower looper for over-edge chain stitching to thereby enable the above-described special stitching to be performed without fail.

To attain the above-described object, the present invention provides a thread spreading apparatus for use in an overlock sewing machine having an over-edge chain stitching mode in which a pair of upper and lower loopers are used, and a multi-thread chain stitching mode in which the upper looper is suspended, and the lower looper is given longitudinal oscillation. The lower looper has a needle thread catch portion shaped so that a needle thread caught by the needle thread catch portion is brought closer to a needle plate when the lower looper moves leftward in order to allow the needle thread to slip off smoothly from the lower looper. The lower looper further has a center of rotation which is rightwardly offset from a needle axis. The thread spreading apparatus includes a needle thread retaining device for retaining the needle thread above the lower looper during the multi-thread chain stitching mode so that a needle drops into a triangle defined by a lower looper thread, the lower looper and the needle thread. The needle thread retaining device is actuated by using the lower looper as a drive source.

In addition, the present invention provides a thread spreading apparatus for use in an overlock sewing machine, which includes a lower looper shaft oscillating both laterally and longitudinally in response to movement of a main shaft of the overlock sewing machine, and a thread retaining device having a thread spreading hook for retaining a needle thread so that a needle drops into a triangle defined by a looper thread, a lower looper and the needle thread. The thread retaining device is capable of oscillating both longitudinally and laterally. The thread spreading apparatus further includes a device for transmitting the longitudinal oscillation of the lower looper shaft to the thread retaining device, and a device for transmitting the lateral oscillation of the lower looper shaft to the thread retaining device.

In addition, the present invention provides a thread spreading apparatus for use in an overlock sewing machine capable of selectively carrying out an over-edge chain stitching mode and a multi-thread chain stitching mode in response to a change-over operation. The overlock sewing machine has a vertically movable needle and a pair of upper and lower oscillatable loopers. The upper looper is stopped from oscillating during the multi-thread chain stitching mode. The thread spreading apparatus includes a lower looper shaft oscillating both laterally and longitudinally in response to movement of a main shaft of the overlock sewing machine, and a thread retaining device having a thread spreading hook for retaining a needle thread so that the needle drops into a triangle defined by a looper thread, the lower looper and the needle thread. The thread retaining device is capable of oscillating both longitudinally and laterally. The thread spreading apparatus further includes a device for transmitting the longitudinal oscillation of the lower looper shaft to the thread retaining device, and a device for transmitting the lateral oscillation of the lower looper shaft to the thread retaining device.

In addition, the present invention provides a thread spreading apparatus for use in an overlock sewing machine capable of selectively performing over-edge chain stitching and at least one other stitching in response to a change-over operation. The overlock sewing machine has a vertically movable needle and a pair of upper and lower oscillatable loopers. The upper looper is stopped from oscillating during stitching other than the over-edge chain stitching. The thread spreading apparatus includes a lower looper shaft oscillating both laterally and longitudinally in response to movement of a main shaft of the overlock sewing machine, and a thread retaining device having a thread spreading hook and capable of rotating both longitudinally and laterally. The thread spreading apparatus further includes a device for transmitting the longitudinal oscillation of the lower looper shaft to the thread spreading hook, and a device for transmitting the lateral oscillation of the lower looper shaft to the thread spreading hook. The thread spreading hook retains a needle thread so that the needle drops into a triangle defined by a looper thread, the lower looper and the needle thread.

The above-described lateral oscillation transmitting device has a cam secured to the lower looper shaft, and a lateral oscillation transmitting pin having one end thereof secured to the thread spreading hook and the other end thereof kept in contact with the cam.

The above-described thread spreading hook is capable of rotating longitudinally about an auxiliary oscillating pin provided forwardly of the distal end of the thread spreading hook.

The thread spreading hook may have a hook portion formed with a projection. The thread spreading hook retains the needle thread by the hook portion so that the needle drops into a triangle defined by the looper thread, the lower looper and the needle thread, and at the same time, pushes out the needle thread retained by the hook portion in a fabric feed direction by the projection, thereby enlarging the triangle.

The arrangement may be such that the thread spreading hook has hook portions the number of which is the same as that of needles, and that the hook portions are disposed so that the height of a hook portion remoter from the distal end of the lower looper is lower than the height of a hook portion closer to the distal end of the lower looper.

In addition, the present invention provides a thread spreading apparatus for use in an overlock sewing machine, which includes a lower looper shaft oscillating both laterally and longitudinally in response to movement of a main shaft of the overlock sewing machine, and a thread spreading hook having a hook portion for retaining a needle thread so that a needle drops into a triangle defined by a looper thread, a lower looper and the needle thread. The thread spreading hook is capable of rotating both longitudinally and laterally. The thread spreading apparatus further includes a device for transmitting the longitudinal oscillation of the lower looper shaft to the thread spreading hook, and a device for transmitting the lateral oscillation of the lower looper shaft to the thread spreading hook.

In addition, the present invention provides a thread spreading apparatus for use in an overlock sewing machine capable of selectively forming a seam in an over-edge chain stitching mode and a multi-thread chain stitching mode. The overlock sewing machine has a vertically movable needle and a pair of upper and lower oscillatable loopers. The upper looper is stopped from oscillating during the multi-thread chain stitching mode. The thread spreading apparatus includes a lower looper shaft oscillating both laterally and longitudinally in response to movement of a main shaft of the overlock sewing machine, and a thread spreading hook having a hook portion and capable of rotating both longitudinally and laterally. The thread spreading apparatus further includes a device for transmitting the longitudinal oscillation of the lower looper shaft to the thread spreading hook, and a device for transmitting the lateral oscillation of the lower looper shaft to the thread spreading hook. The hook portion of the thread spreading hook is arranged such that during the multi-thread chain stitching mode, the hook portion retains a needle thread so that the needle drops into a triangle defined by a looper thread, the lower looper and the needle thread, whereas during the over-edge chain stitching mode, the hook portion lies rearwardly of an idle chain stitch forming bore provided in a needle plate of the overlock sewing machine.

In operation, when the lower looper shaft oscillates both laterally and longitudinally in response to the movement of the main shaft, the longitudinal oscillation of the lower looper shaft is transmitted to the thread spreading hook by the longitudinal oscillation transmitting device, while the lateral oscillation of the lower looper shaft is transmitted to the thread spreading hook by the lateral oscillation transmitting device.

The longitudinal and lateral oscillations transmitted in this way are combined together to cause the thread spreading hook to oscillate both longitudinally and laterally. Thus, when two needles drop, each needle thread is retained by the thread spreading hook so that a triangle is actively formed by the lower looper thread, the lower looper and the needle thread. Each needle drops into the triangle thus formed.

At this time, in a case where the thread spreading hook has a hook portion formed with a projection, the rearward portion of the needle thread is pushed out in the fabric feed direction by the projection provided on the hook portion of the thread spreading hook. As a result, the angle made by the lower looper thread and the lower looper is enlarged, so that the needle can surely drop into the space defined between the lower looper and the looper thread.

In a case where the thread spreading hook is arranged such that the height of a hook portion remote from the distal end of the lower looper is lower than the height of a hook portion closer to the distal end of the lower looper, the lower looper thread passes over the first-mentioned hook portion. Accordingly, a complete triangle is formed, and no skip stitching occurs.

In a case where the hook portion of the thread spreading hook Is disposed rearwardly of the idle chain stitch forming bore provided in the needle plate of the overlock sewing machine, there is no likelihood that an idle chain stitch will get entangled with the hook portion during over-edge chain stitching.

BRIEF DESCRIPTION OF THE DRAWINGS

The above and other objects, features and advantages of the present invention will become more apparent from the following description of the preferred embodiments thereof, taken in conjunction with the accompanying drawings, in which like reference numerals denote like elements, and of which:

FIGS. 5(A) and 5(B) schematically show the positional relationship between needle threads, a looper thread and a lower looper when needles descend, in which FIG. 5(A) shows an improper positional relationship, and FIG. 5(B) shows a proper positional relationship;

FIGS. 33(A) and 33(B) schematically show the positional relationship between the needle threads, the looper thread and the lower looper when the needles descend, in which FIG. 33(A) shows an improper positional relationship, and FIG. 33(B) shows a proper positional relationship;

DESCRIPTION OF THE PREFERRED EMBODIMENTS

Embodiments of the thread spreading apparatus for use in an overlock sewing machine according to the present invention will be described below with reference to the accompanying drawings.

First Embodiment

Figure 1:
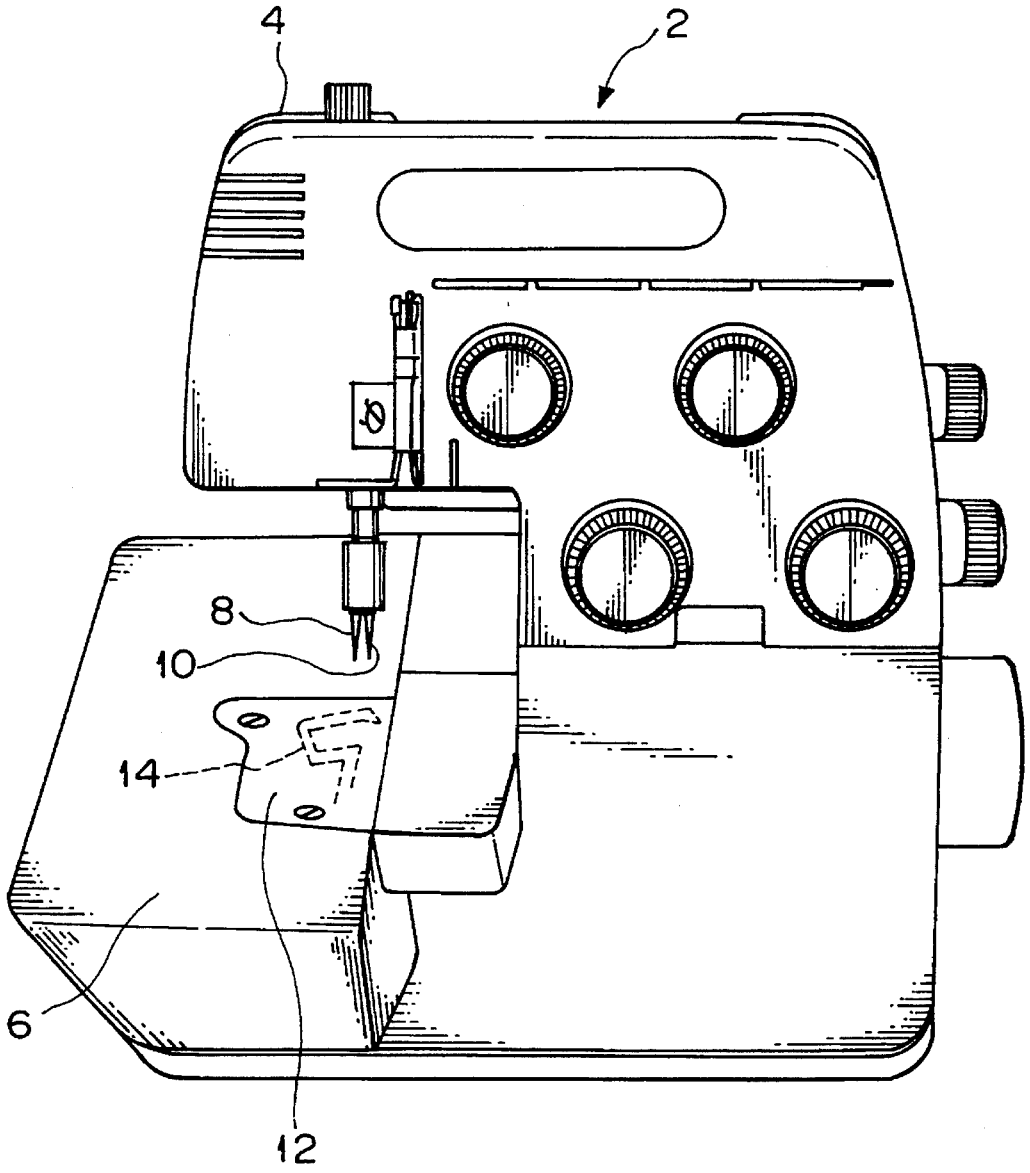
FIG. 1 is a perspective view showing the whole of an overlock sewing machine to which the thread spreading apparatus of the present invention is suitably applied.

FIG. 1 is a perspective view showing the whole of an overlock sewing machine using two needles, for example, to which the thread spreading apparatus according to the first embodiment of the present invention is suitably applied. The overlock sewing machine 2 has an arm 4 and a bed or base 6. The arm 4 is provided with two needles 8 and 10 so that the needles 8 and 10 are vertically movable with respect to the bed 6. The bed 6 is provided with a needle plate 12 lying below the needles 8 and 10. A lower looper 14 is provided below the needle plate 12.

It should be noted that the illustrated overlock sewing machine 2 is an overlock sewing machine capable of performing over-edge chain stitching, multi-thread chain stitching and covering chain stitching, which is provided with an upper looper (not shown) in addition to the lower looper 14. During multi-thread chain stitching or covering chain stitching, the oscillating motion of the upper looper is suspended by a change-over device (not shown) disclosed in the specification and drawings of Japanese Patent Application No. 3-79670 (U.S. Pat. No. 5,255,622).

Figure 2:
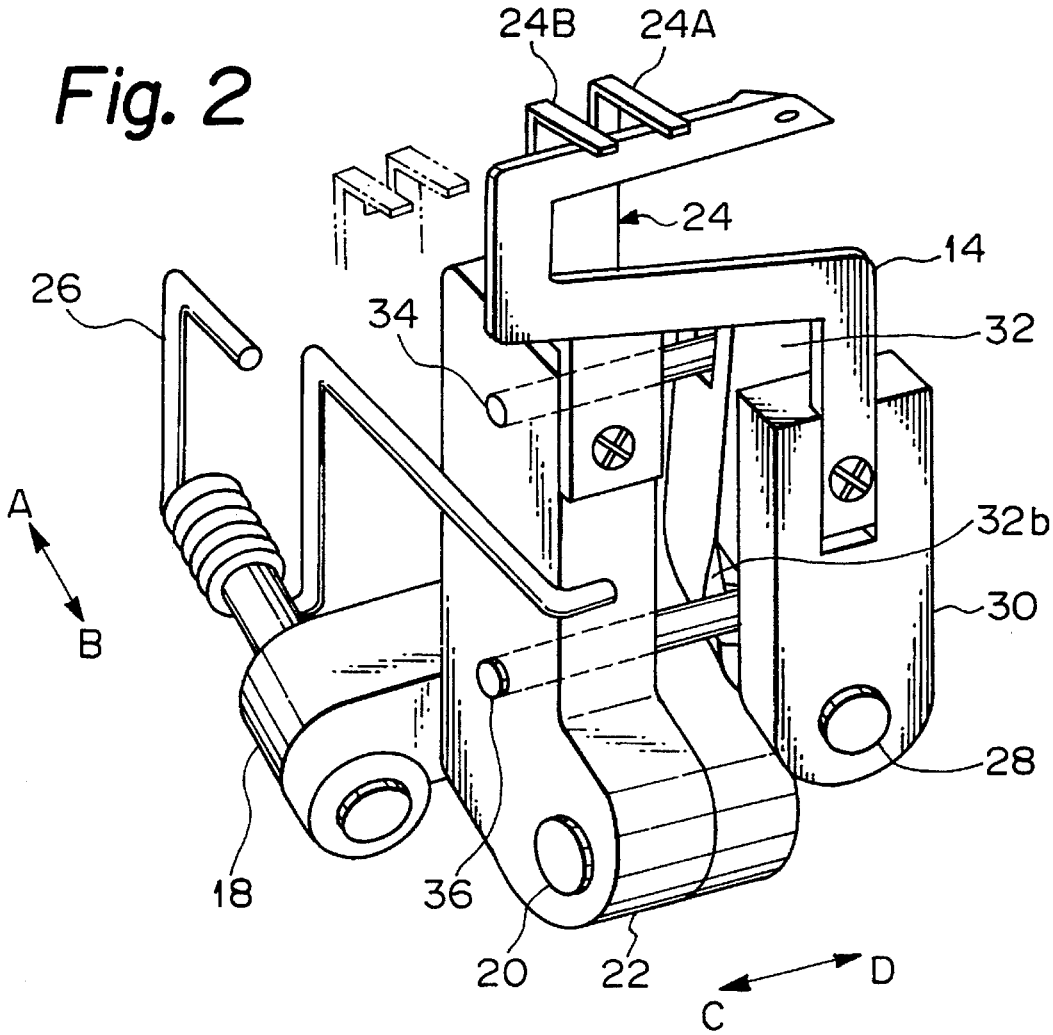
FIG. 2 is a perspective view of the first embodiment of the thread spreading apparatus according to the present invention.
Figure 3:
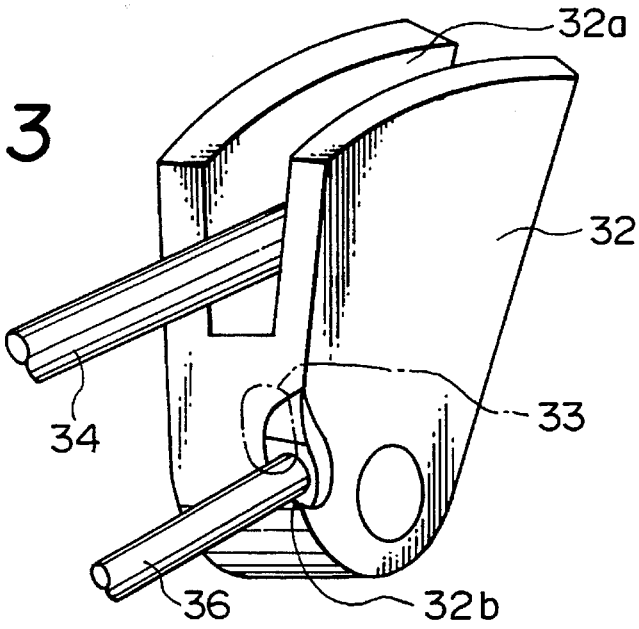
FIG. 3 is a perspective view of one part of the embodiment shown in FIG. 2.
Figure 4:
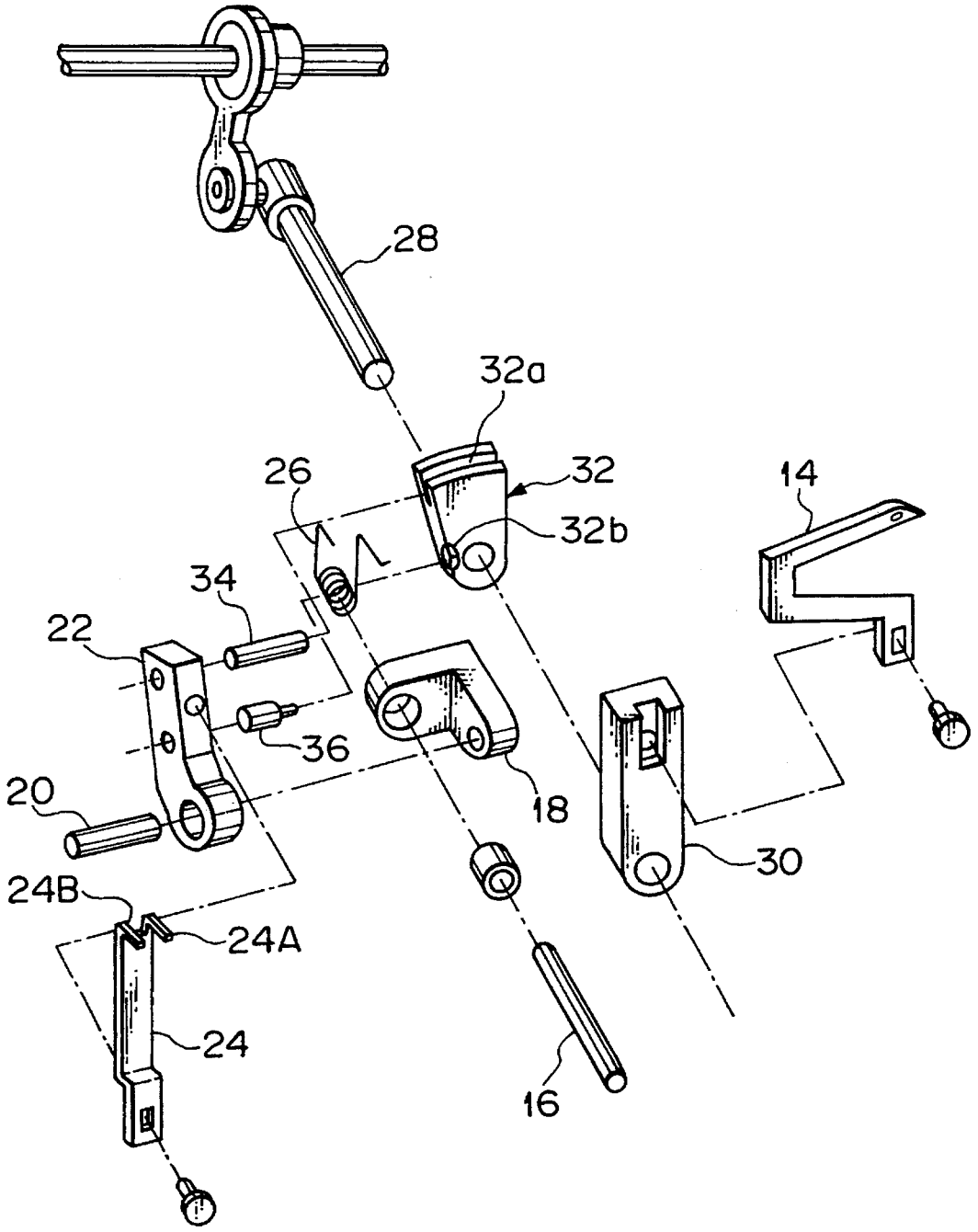
FIG. 4 is an exploded perspective view of the embodiment shown in FIG. 2.

FIG. 2 is a perspective view of the first embodiment, FIG. 3 is a perspective view of one part of the first embodiment, and FIG. 4 is an exploded perspective view of the first embodiment. Referring to FIG. 2, a hook rotating shaft 16 (FIG. 4) is secured to the bed or base 6, and a support member 18 is rotatably attached to the hook rotating shaft 16. The hook rotating shaft 16 extends longitudinally of the machine (i.e., the direction AB as viewed in the figure). During operation of the sewing machine 2, fabric or other material is moved along a feed path relative to the bed or base 6 and needle plate 12 in the direction indicated by the arrow A in FIG. 2.

A hook oscillating arm 22 is rotatably attached to the support member 18 through an auxiliary oscillating pin 20. The auxiliary oscillating pin 20 extends laterally of the machine (i.e., in the direction CD as viewed in the figure).

A thread spreading hook or positioning member 24 is screwed to the hook oscillating arm arm support member 22. The thread spreading hook or positioning member 24 is longitudinally pivotable relative to the bed or base 6 and needle plate 12 (FIG. 1) about the auxiliary oscillating pin 20, together with the hook oscillating arm 22 as one unit. In an operative state, the thread spreading hook 24 lies in the position shown by the solid line in the figure, whereas, in an inoperative state, it lies in the position shown by the two-dot and dash line. It should be noted that the term "operative state" herein means a state where the thread spreading hook 24 retains needle threads so that a triangle is defined by each needle thread, a looper thread and the lower looper 14, as described later.

A torsion spring 26 is attached to the hook rotating shaft 16. The torsion spring 26 has one working end retained by the machine frame and the other end abutting against the hook oscillating arm 22, thereby constantly biasing the hook oscillating arm 22 rightwardly.

A lower looper shaft 28 extends longitudinally of the machine. When a main shaft (not shown) rotates, the lower looper shaft 28 is caused to oscillate laterally through a looper cam, a looper rod, etc. (which are not shown) by using the main shaft as a drive source, and it is also allowed to move longitudinally through a multi-thread chain stitching cam, a longitudinal oscillating shaft, etc. (which are not shown). It should be noted that when over-edge chain stitching is to be performed, the main shaft and the lower looper shaft 28 are disconnected from each other by the change-over device (not shown) so that the lower looper shaft 28 will not perform longitudinal reciprocating motion, and at this time, the thread spreading hook 24 performs only the lateral pivotal motion at the position shown by the two-dot and dash line in the figure.

A lower looper support arm 30 is secured to the lower looper shaft 28. The lower looper 14 is screwed to the lower looper support arm 30.

In addition, a hook oscillating collar (oscillation transmitting arm) 32 is secured to the lower looper shaft 28. The hook oscillating collar 32 has a bifurcated portion **32*a* at the top thereof and a cam portion 32*b*** at the bottom thereof.

One end of a longitudinal oscillation transmitting pin 34 and one end of a lateral oscillation transmitting pin 36 are secured to the hook oscillating arm 22. The other end of the longitudinal oscillation transmitting pin 34 is fitted in the bifurcated portion **32*a* of the hook oscillating collar 32. The other end of the lateral oscillation transmitting pin 36 is in contact with the cam portion 32*b* of the hook oscillating collar 32. Accordingly, the longitudinal and lateral oscillations of the lower looper shaft 28 relative to the bed or base 6 and needle plate 12 (FIG. 1) are transmitted to the hook oscillating arm or support member 22 (FIG. 2) through the hook oscillating collar 32. It should be noted that the longitudinal oscillation transmitting pin 34, the bifurcated portion 32*a* of the hook oscillating collar 32, etc. constitute a longitudinal oscillation transmitting device, and the lateral oscillation transmitting pin 36, the cam portion 32*b* of the hook oscillating collar 32**, etc. constitute a lateral oscillation transmitting device.

That is, when the lower looper shaft 28 oscillates longitudinally, that is, along the material feed path which extends parallel to the arrow A-B in FIG. 2, the hook oscillating collar 32 also performs longitudinal oscillation together with the lower looper shaft 28. This motion is transmitted to the hook oscillating arm 22 through the longitudinal oscillation transmitting pin 34 fitted in the bifurcated portion **32*a* of the hook oscillating collar 32. As a result, the hook oscillating arm 22 oscillates longitudinally about the auxiliary oscillating pin 20**.

When the lower looper shaft 28 oscillates laterally, that is, transversely to the material feed path, the hook oscillating collar 32 also performs lateral oscillation together with the lower looper shaft 28. This motion is transmitted to the hook oscillating arm 22 through the lateral oscillation transmitting pin 36. As a result, the hook oscillating arm 22 oscillates laterally about the hook rotating shaft 16. Since the lateral oscillation transmitting pin 36 is kept in contact with the cam portion **32*b* of the hook oscillating collar 32 by the biasing force from the torsion spring 26, the hook oscillating arm 22 performs lateral oscillating motion along the profile of the cam portion 32*b*. It should be noted that reference numeral 33 in FIG. 3 denotes the locus of the point of contact between the lateral oscillation transmitting pin 36 and the hook oscillating collar 32**.

Thus, the motion of the thread spreading hook 24 draws a special locus close to a D-shape, as described later, by motion composed of the longitudinal oscillating motion caused by the hook oscillating arm 22, the longitudinal oscillation transmitting pin 34 and the bifurcated portion **32*a* of the hook oscillating collar 32 and the lateral oscillating motion caused by the hook oscillating arm 22, the lateral oscillation transmitting pin 36 and the cam portion 32*b* of the hook oscillating collar 32**.

Figure 34A:
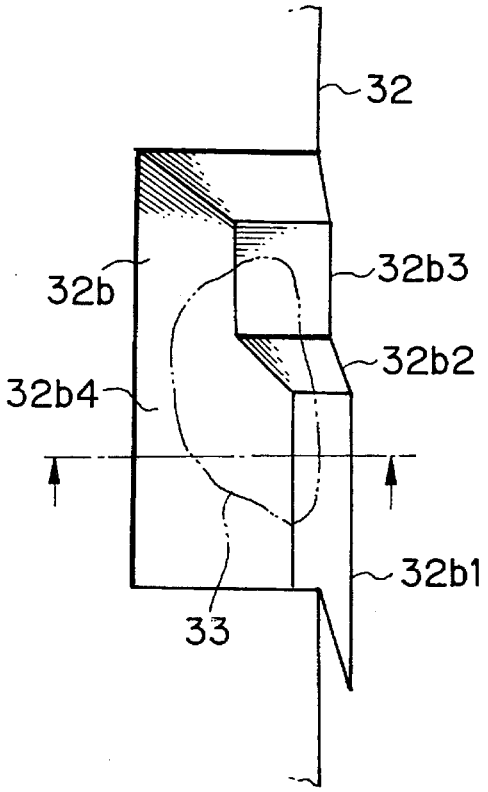
FIGS. 34(A) and 34(B) are perspective and end views of a cam constituting a lateral oscillation transmitting device.
Figure 34B:
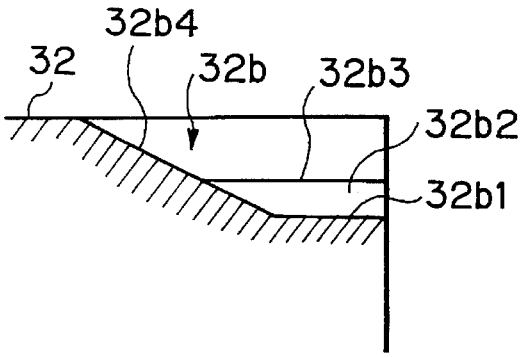
Figure 35:
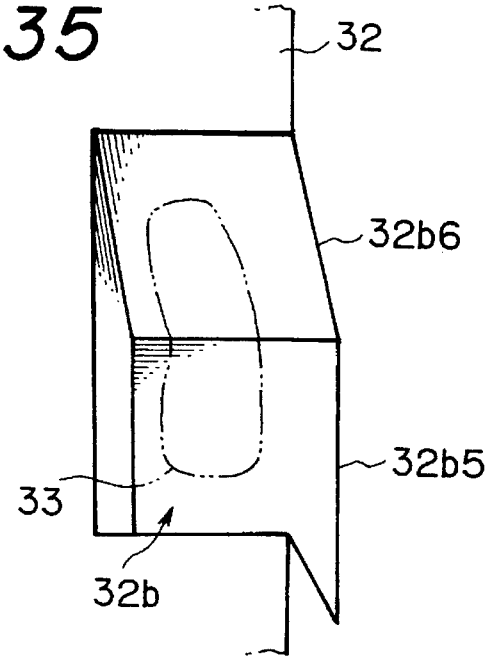
FIG. 35 is a perspective view of a cam constituting a lateral oscillation transmitting device in another example.

FIGS. 34(A) and 34(B) show the cam portion **32*b* more specifically. The cam portion 32*b* has a cam surface 32*b* composed of a low portion 32*b*1, a slant portion 32*b*2, a high portion 32*b*3, and a slant portion 32*b*4. The pin 34 is in engagement with the cam surface 32*b*. FIG. 35 shows another example of the cam surface 32*b*, in which it is composed only of a low portion 32*b*5 and a slant portion 32*b*6**.

Figure 5A:
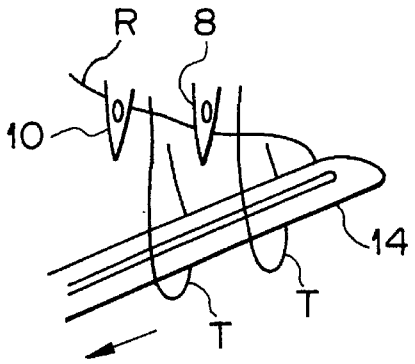
Figure 5B:
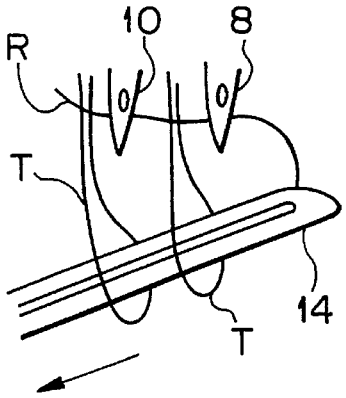

FIGS. 5(A) and 5(B) schematically show the positional relationship between needle threads T, a looper thread R and the lower looper 14 when the needles 8 and 10 descend. FIG. 5(A) shows an Improper positional relationship, while FIG. 5(B) shows a proper positional relationship. In FIG. 5(A), when the lower looper 14 moves leftward (in the direction of the arrow), the needle threads T slide rightward relative to the lower looper 14. In this case, each of the needles 8 and 10 undesirably drops on the left-hand side of the corresponding needle thread T. In the case of the proper stitching shown in FIG. 5(B), each of the needles 8 and 10 descends into a triangle defined by the needle thread T, the looper thread R and the looper 14.

FIGS. 6(A) to 10(B) show the needles 8 and 10, the lower looper 14 and the thread spreading hook 24 at each step of a sewing operation. In these figures, FIGS. 6(A), 7(A), 8(A), 9(A) and 10(A) are plan views, and FIGS. 6(B), 7(B), 8(B), 9(B) and 10(B) are front views.

Figure 6A:
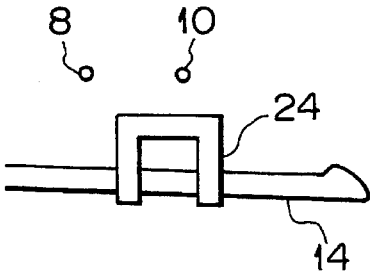
FIGS. 6(A) and 6(B) are plan and front views schematically showing the needles, the lower looper and a thread spreading hook when the needles are at the top dead center.
Figure 6B:
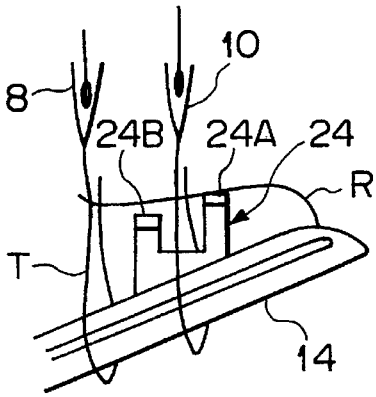
Figure 7A:
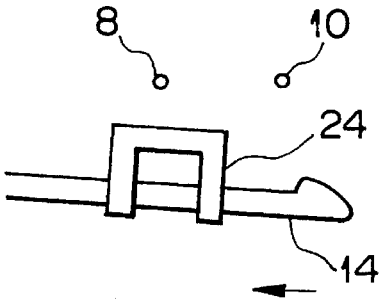
FIGS. 7(A) and 7(B) are plan and front views schematically showing the needles, the lower looper and the thread spreading hook when the needles are at the upper side of a needle plate of the overlock sewing machine.
Figure 7B:
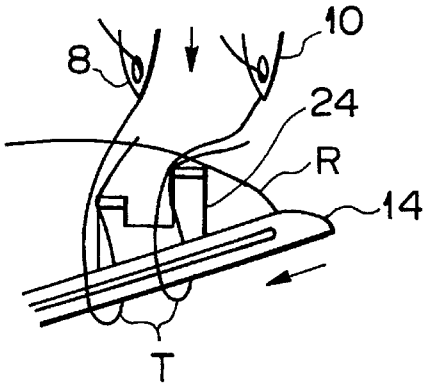

FIGS. 6(A) and 6(B) show a state where the needles 8 and 10 are at the top dead center at the beginning of a stitch. At this time, the thread spreading hook 24 is at the foremost position, and the lower looper 14 is at the most rightward position. The needles 8 and 10 are disposed above the needle plate 12. FIGS. 7(A) and 7(B) show a state where the needles 8 and 10 are at the upper side of the needle plate 12. At this time, the thread spreading hook 24 is at the most leftward position, and the lower looper 14 has begun to move leftward from the most rightward position.

Figure 8A:
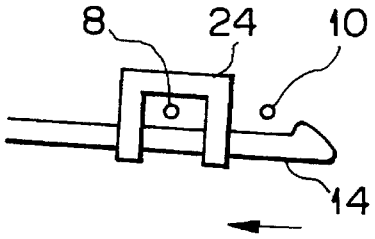
FIGS. 8(A) and 8(B) are plan and front views schematically showing the needles, the lower looper and the thread spreading hook when each needle has dropped into a triangle defined by the corresponding needle thread, the looper thread and the lower looper.
Figure 8B:
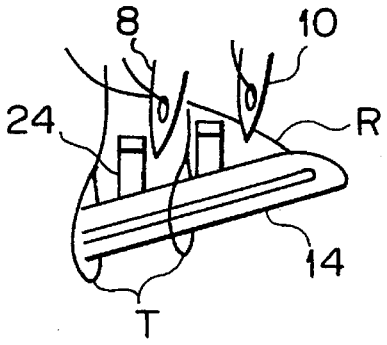

FIGS. 8(A) and 8(B) show a state where the needles 8 and 10 extended through the needle plate 12. At this time, the needle threads T tend to move rightward as viewed in FIG.

8(B) relative to the lower looper 14 as it moves leftward. However, the needle threads T are retained by the thread spreading hook 24 and thus prevented from moving rightward relative to the lower looper 14. Accordingly, each of the needles 8 and 10 surely drops into a triangular area defined by the corresponding needle thread T, the looper thread R and the lower looper 14.

Figure 9A:
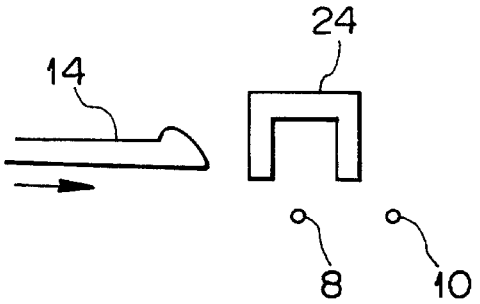
FIGS. 9(A) and 9(B) are plan and front views schematically showing the needles, the lower looper and the thread spreading hook when the needles are at the bottom dead center.
Figure 9B:
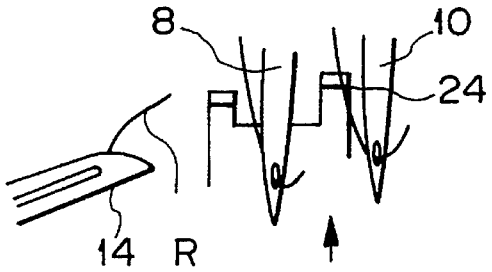
Figure 10A:
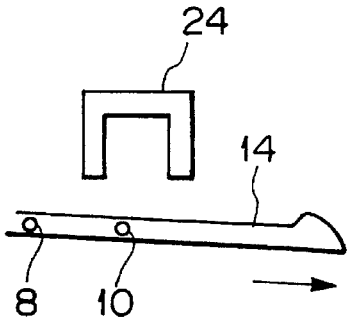
FIGS. 10(A) and 10(B) are plan and front views schematically showing the needles, the lower looper and the thread spreading hook when the needles have moved to a position above the needle plate.
Figure 10B:
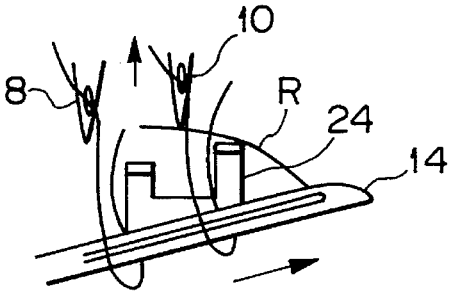

FIGS. 9(A) and 9(B) show a state where the needles 8 and 10 are at the bottom dead center. At this time, the thread spreading hook 24 and the lower looper 14 are each at the rearmost leftward position. FIGS. 10(A) and 10(B) show a state where the needles 8 and 10 have moved to a position above the needle plate 12. At this time, the thread spreading hook 24 has moved to a rear rightward position, and the lower looper 14 has moved to a rightward position. Then, the system returns to the state shown in FIG. 6. Thereafter, the steps shown in FIGS. 7(A) to 9(B) are repeated.

Figure 11:
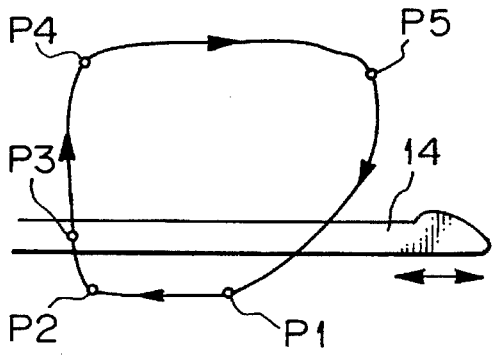
FIG. 11 schematically shows a locus of motion of the thread spreading hook at each of the steps shown in FIGS. 6(A) to 10(B)

FIG. 11 schematically shows the locus of motion of the thread spreading hook 24 at each of the steps shown in FIGS. 6(A) to 10(B). In the figure, reference symbols P1 to P5 denote the positions of the thread spreading hook 24 at the steps shown in FIGS. 6(A) to 10(B). The profile of the cam portion 32*b* of the hook oscillating collar 32 is designed so that the thread spreading hook 24 draws a locus close to a D-shape such as that shown in FIG. 11.

With the above-described arrangement of the thread spreading apparatus in the first embodiment, the thread spreading hook 24 is caused to move along an approximately D-shaped locus by using the longitudinal and lateral oscillating motion of the lower looper shaft 28, thereby enabling a triangle to be actively formed by the needle thread T, the looper thread R and the lower looper 14 at a position under each of the needles 8 and 10.

It should be noted that when a thick thread is used as a looper thread, if the position of the thread spreading hook 24 in the inoperative state is close to the needle plate 12, the looper thread may become entangled with the thread spreading hook 24. Therefore, it is preferable to set the position of the auxiliary oscillating pin 20 forwardly (the direction B) of the distal end of the thread spreading hook 24 as viewed in FIG. 2. Thus, the auxiliary oscillating pin 20 is spaced from the thread spreading hook or positioning member 24 in a direction opposite to the direction of movement of material through the sewing machine 2 along the needle plate 12. In this case, the position of the thread spreading hook 24 in the inoperative state is lower than that in the operative state, and thus the space between the thread spreading hook 24 and the needle plate 12 in the inoperative state is enlarged. Accordingly, there is no likelihood that the looper thread will get entangled with the thread spreading hook 24.

Figure 24A:
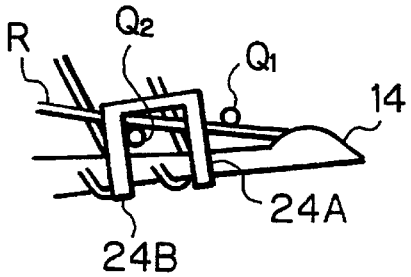
FIGS. 24(A) and 24(B) are plan and front views for explanation of a problem arising at the beginning of a sewing operation when two hook portions of the thread spreading hook are provided at the same height.
Figure 24B:
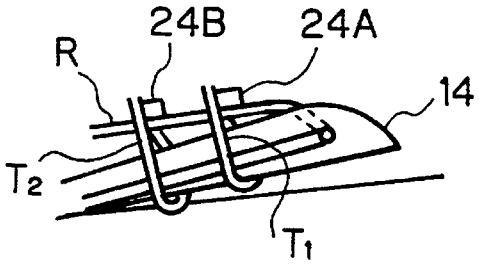
Figure 27:
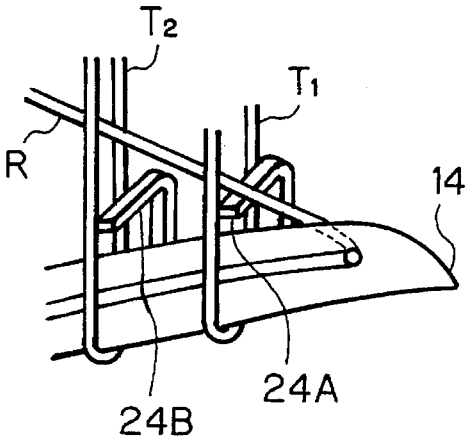
FIG. 27 is a perspective view schematically showing the needles, the lower looper and the thread spreading hook after the beginning of the sewing operation.

As shown in FIGS. 24(A), 24(B), 25(A) and 25(B), at the beginning of a sewing operation, the looper thread R that forms a triangle lies close to the upper side of the lower looper 14 (for the position of the looper thread R after the beginning of the sewing operation, see FIG. 27). Therefore, when two hook or arm portions 24A and 24B of the thread spreading hook or positioning member 24 are provided at the same height, as shown in FIG. 24, the looper thread R may pass under the hook portion 24B and may be held by the root of the hook portion 24B. In such a case, no proper triangle is formed, as shown in FIG. 24(B). Therefore, right-hand needle (Q1) is likely to fail to enter the triangle, causing a skip stitch.

Figure 23:
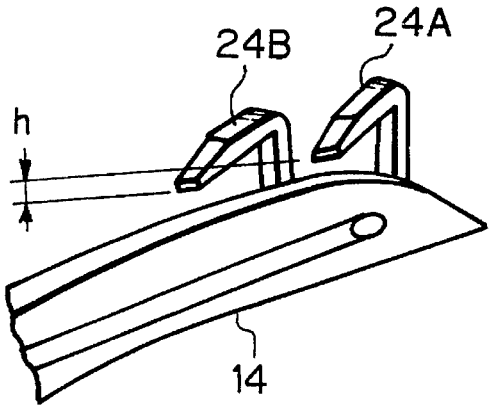
FIG. 23 is an enlarged perspective view showing an essential part of a third embodiment of the present invention.

For this reason, it is preferable to arrange the thread spreading hook or arm 24 such that, as shown in FIG. 23, the height of the hook or arm portion 24B which is remoter from the distal end (the right-hand end as viewed in FIGS. 2 and 5) of the lower looper 14 is lower than the height of the hook or arm portion 24A which is closer to the distal end of the lower looper 14. Thus, when the thread spreading hook or positioning member 24 is in the operative state, the hook or arm portion 24A is closer to the needle plate 12 and to the path of movement of the material through the sewing machine 2 than the hook or arm portion 24B. It should be noted that in the illustrated example the lower looper 14 faces rightward; when a looper which faces leftward is used, the right-hand hook portion 24A as viewed in FIG. 2 is made lower than the left-hand hook portion 24B.

Figure 25A:
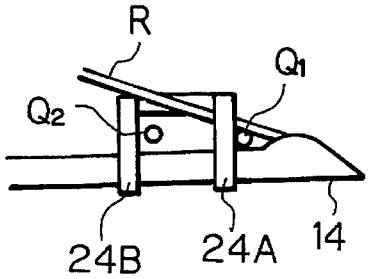
FIGS. 25(A) and 25(B) are plan and front view for explaining that the problem shown in FIGS. 24(A) and 24(B) can be solved by arranging the thread spreading hook such that the two hook portions have different heights.
Figure 25B:
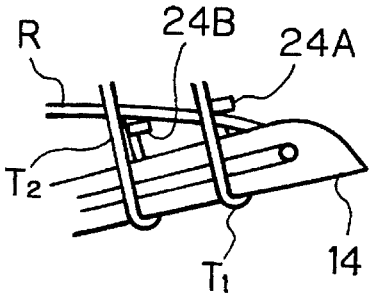

Thus, the looper thread R passes over the hook portion 24B, as shown In FIG. 25(A), and a proper triangle is formed, as shown in FIG. 25(B). Thus, the problem of skip stitch is solved.

Figure 26:
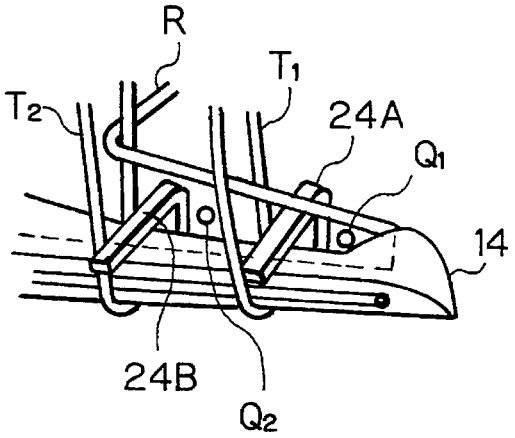
FIG. 26 is a perspective view schematically showing the needles, the lower looper and the thread spreading hook after the beginning of the sewing operation.

It should be noted that after the beginning of the sewing operation, the looper thread R passes over the two hook portions 24A and 24B, as shown in FIGS. 26 and 27, the figures, reference symbol Q1 denotes the location of the right-hand needle, and Q2 denotes the location of the lefthand needle.

Figure 28:
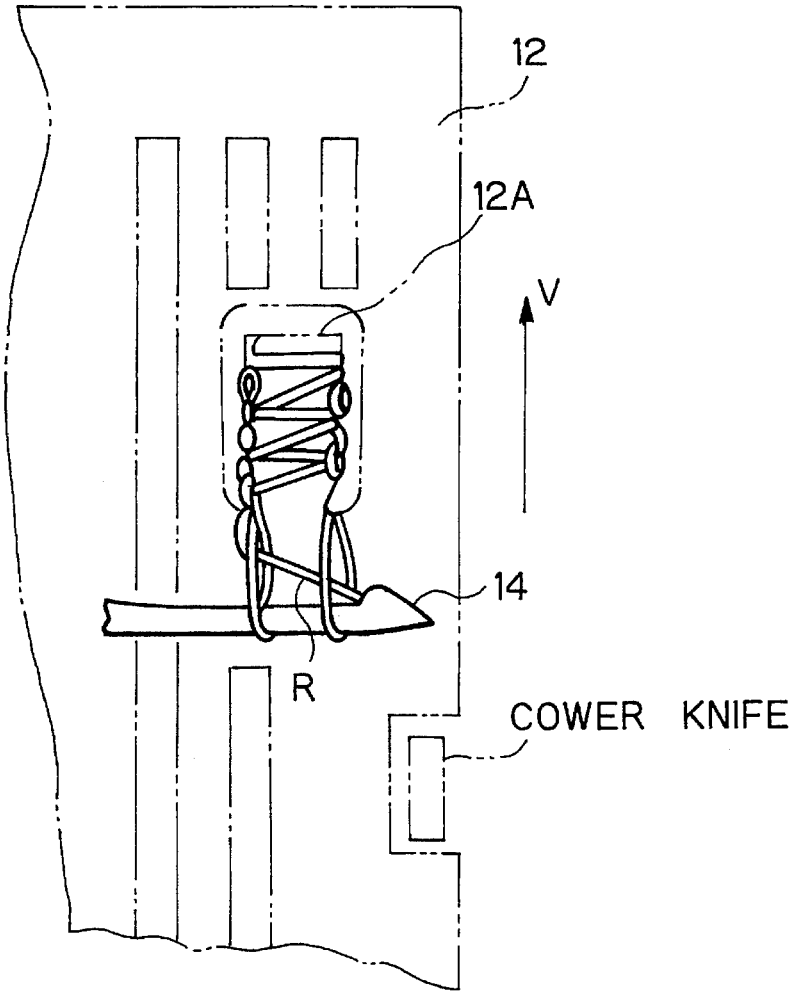
FIG. 28 is a plan view of the lower looper as viewed from above the needle plate.
Figure 29:
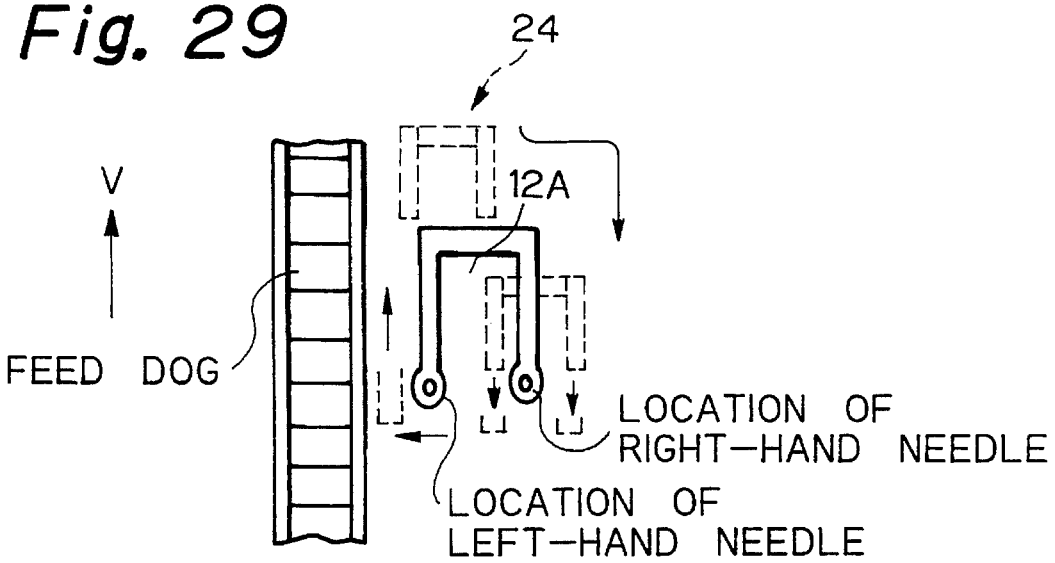
FIG. 29 is a plan view showing a fabric feed direction and a locus of motion of the thread spreading hook as viewed from above the needle plate.

FIGS. 28 and 29 are plan views of the lower looper 14 and other associated elements as viewed from above the needle plate 12. As shown in these figures, the needle plate 12 is provided with a seam forming member 12A. The seam forming member 12A is used to form a seam when multi-thread chain stitching is performed using two needles.

As shown in FIG. 28, the looper thread R extends from the seam forming member 12A to the lower looper 14 below it. The arrow V in FIG. 29 indicates the fabric feed direction. The thread spreading hook 24 draws an approximately D-shaped locus of motion, as described above, and when it moves in the opposite direction to the fabric feed direction under the seam forming member 12A, the looper thread R is likely to get caught by the hook portion 24A or 24B of the thread spreading hook 24.

The above phenomenon is particularly likely to occur when a thick thread is used as a lower looper thread. Since the thread spreading hook 24 in this embodiment is arranged such that the height of the hook portion 24B, which is remoter from the distal end of the lower looper 14, is lower than the height of the hook portion 24A, which is closer to the distal end of the lower looper 14, even when a thick looper thread R is used, there is no possibility of the thread R being caught by the hook portion 24A or 24B of the thread spreading hook 24.

Second Embodiment

Figure 12:
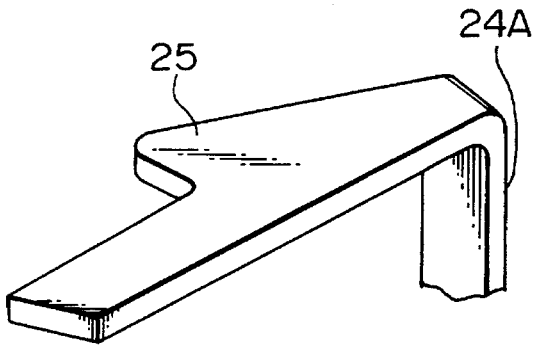
FIG. 12 is an enlarged perspective view of an essential part of a second embodiment of the present invention.

FIG. 12 is a perspective view of a hook portion of a thread spreading hook used in the thread spreading apparatus of the second embodiment. The thread spreading hook or positioning member 24 has two hook or arm portions 24A and 24B. The hook portion (right-hand hook portion) 24A, which Is closer to the distal end (the right-hand end as viewed in FIG. 2) of the lower looper 14, and the hook portion (left-hand hook portion) 24B, which is remoter from the distal end of the lower looper 14, have different configurations.

That is, as shown in FIG. 12 in detail, the right-hand hook portion 24A has a projection 25 formed on the left-hand side thereof. On the other hand, the left-hand hook portion 24B is formed in the shape of a narrow straight bar. The projection 25 on the hook portion or arm 24A has a sloping edge portion which slopes away from an outer end of the hook portion or arm 24A and away from the left hook portion or arm 24B. It should be noted that in the illustrated example the lower looper 14 faces rightward; when a lower looper which faces leftward is used, the hook portion which is closer to the distal end of the lower looper is the right-hand hook portion 24A in FIG. 2 (however, the projection 25 is changed so as to face in the opposite direction to the above), and the hook portion which is remoter from the distal end of the lower looper is the left-hand hook portion 24B in FIG. 2. The height of the right-hand hook portion 24A is made higher than the height of the left-hand hook portion 24B.

It should be noted that since the rest of the thread spreading apparatus in the second embodiment has the same arrangement as that in the first embodiment, illustration thereof is omitted.

Figure 13:
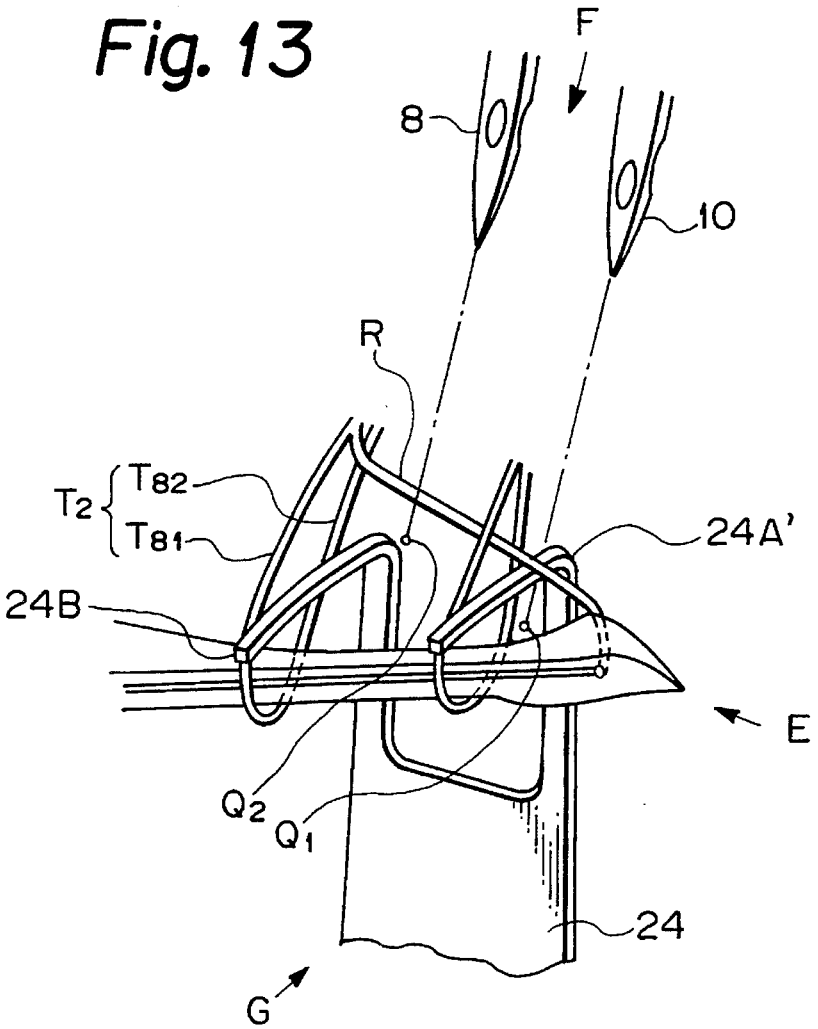
FIG. 13 is a view for explanation of a problem arising at the beginning of a sewing operation when two hook portions of the thread spreading hook are provided at the same height.
Figure 14:
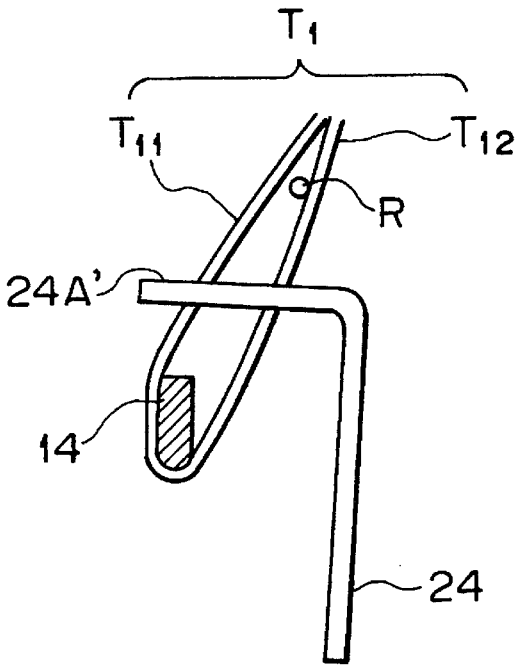
FIG. 14 is a view as seen from the direction of the arrow E in FIG. 13.
Figure 15:
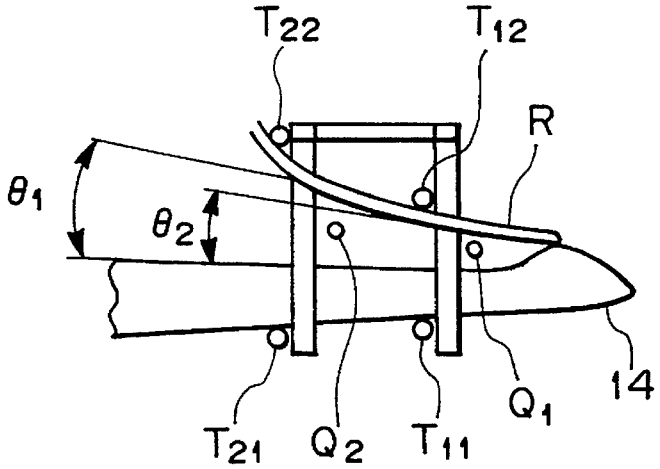
FIG. 15 is a view as seen from the direction of the arrow F in FIG. 13.
Figure 16:
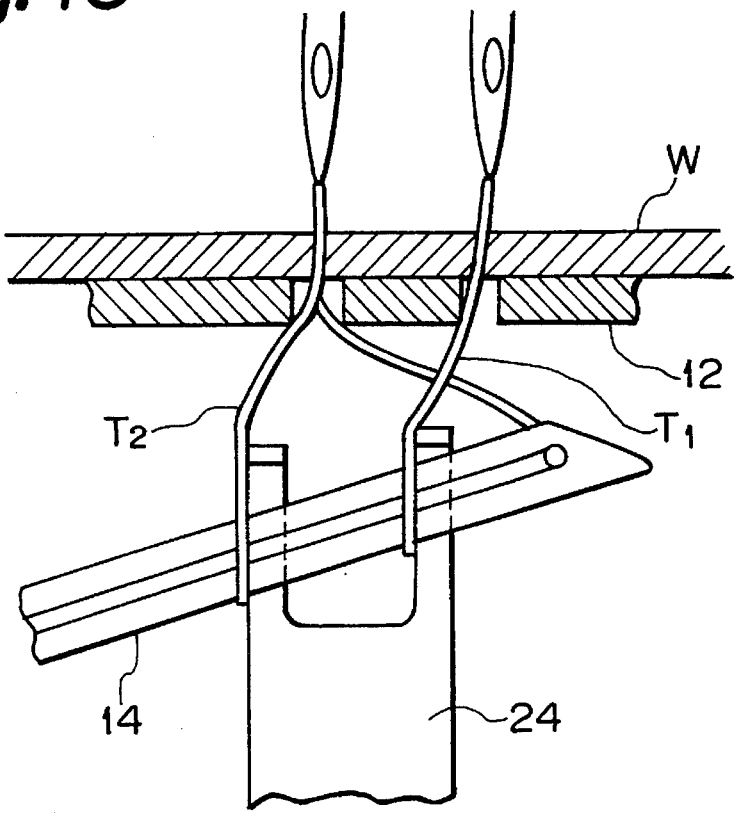
FIG. 16 is a view as seen from the direction of the arrow G in FIG. 13.

FIGS. 13 to 16 are views for explanation of a problem arising when both the right-hand hook portion 24A' and the left-hand hook portion 24B are formed in a bar-like shape, in which: FIG. 13 is a perspective view; FIG. 14 is a view as seen from the direction of the arrow E in FIG. 13; FIG. 15 is a view as seen from the direction of the arrow F in FIG. 13; and FIG. 16 is a view as seen from the direction of the arrow G in FIG. 13. In these figures, the right-hand needle thread T1 is composed of a forward portion T11 and a rearward portion T12, and the left-hand needle thread T2 is similarly composed of a forward portion T21 and a rearward portion T22.

The looper thread R is in contact with the rearward portions T12 and T22 of the right- and left-hand needle threads T1 and T2. Accordingly, there is a difference in the angle made by the looper thread R and the lower looper 14 between the section between the two hook portions 24A' and 24B and the section between the distal end of the lower looper 14 and the right-hand hook portion 24A'. Assuming that the former angle is θ1 and the latter angle is θ2, since the right-hand needle thread T1, the left-hand needle thread T2 and the looper thread R continue from the previous knot of the fabric W, the angle θ1 made by the looper thread R and the lower looper 14 at the section between the two hook portions 24A' and 24B is determined only by the feed pitch.

Accordingly, as the fabric is fed, the position of the looper thread R is shifted relative to the needle location by an amount corresponding to the feed pitch, resulting in the angle θ1. Thus, the needles can drop in the space defined between the lower looper 14 and the looper thread R.

On the other hand, the angle θ2 made by the looper thread R and the lower looper 14 at the section between the distal end of the lower looper 14 and the right-hand hook portion 24A' is determined by the position of the right-hand needle thread T1, and θ2 is smaller than θ1. Accordingly, when the feed pitch is small, θ2 becomes exceedingly small. There is therefore a likelihood that the right-hand needle 10 will fail to drop in the space defined between the lower looper 14 and the looper thread R, causing a skip stitch. In the figures, reference symbol Q1 denotes the location of the right-hand needle 10, and Q2 denotes the location of the left-hand needle 8.

Figure 17:
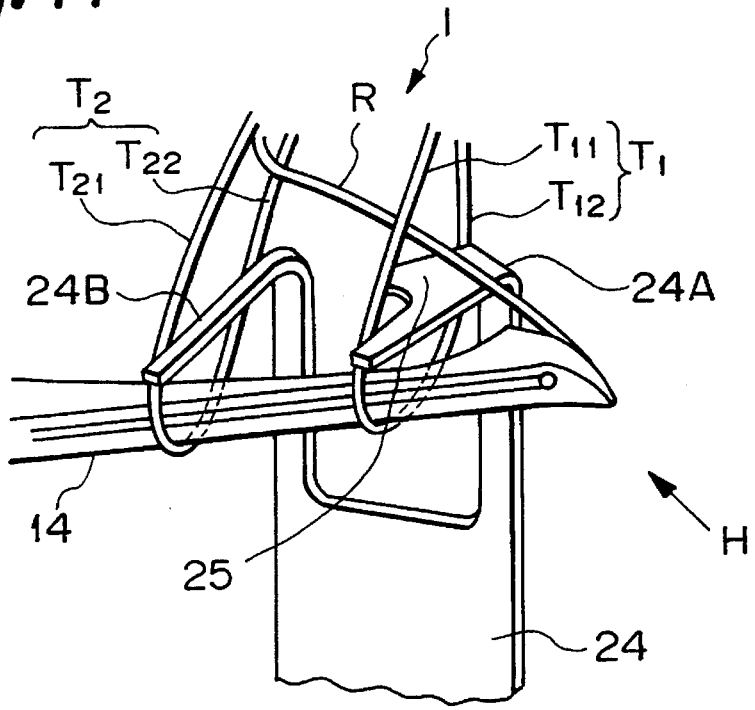
FIG. 17 is a perspective view for explaining that the problem shown in FIG. 13 can be solved by the thread spreading hook in the second embodiment.
Figure 18:
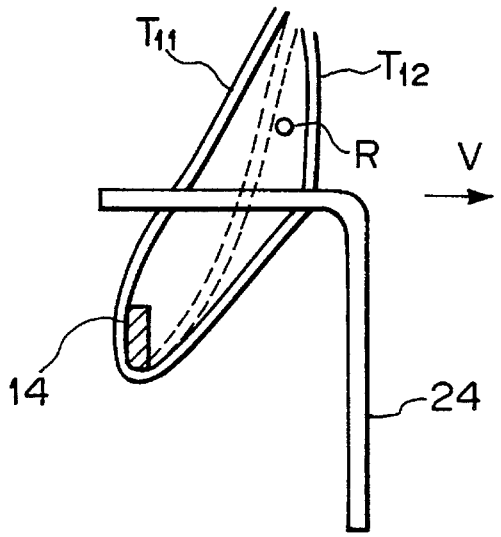
FIG. 18 is a view as seen from the direction of the arrow ti in FIG. 17.
Figure 19:
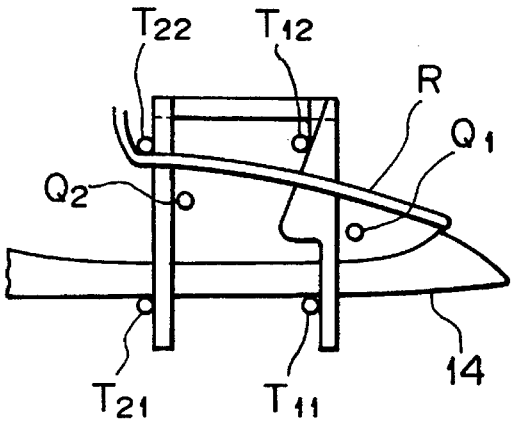
FIG. 19 is a view as seen from the direction of the arrow I in FIG. 17.
Figure 20:
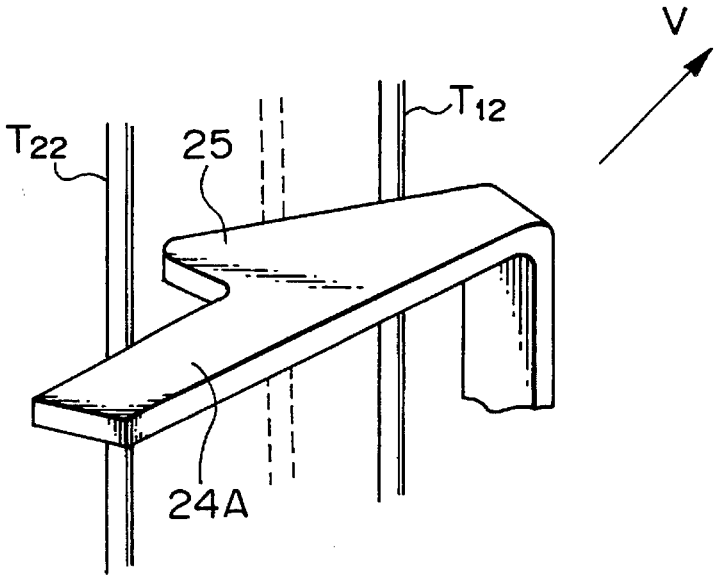
FIG. 20 is an enlarged perspective view of an essential part of the arrangement shown in FIG. 17.

FIGS. 17 to 20 are views for explaining that the above-described problem can be solved by the thread spreading hook 24 in the second embodiment, in which: FIG. 17 is a perspective view; FIG. 18 is a view as seen from the direction of the arrow H in FIG. 17; FIG. 19 is a view as seen from the direction of the arrow I in FIG. 17; and FIG. 20 is an enlarged perspective view of an essential part of the arrangement shown in FIG. 17.

Referring to these figures, the rearward portion T12 of the right-hand needle thread T1 is pushed or deflected out in the fabric feed direction (the direction of the arrow V in FIGS. 18 and 20) by the slant or sloping surface of the projection 25 provided on the right-hand hook or arm portion 24A of the thread spreading hook or positioning member 24. As a result, the angle made by the looper thread R and the lower looper 14 at the section between the distal end of the lower looper 14 and the right-hand hook portion 24A is enlarged. Accordingly, even when the feed pitch is small, the right-hand needle 10 can surely drop in the space defined between the lower looper 14 and the looper thread R. It should be noted that the dotted line in FIGS. 18 and 20 shows the position of the needle thread in the case of the arrangement shown in FIG. 14.

Figure 21A:
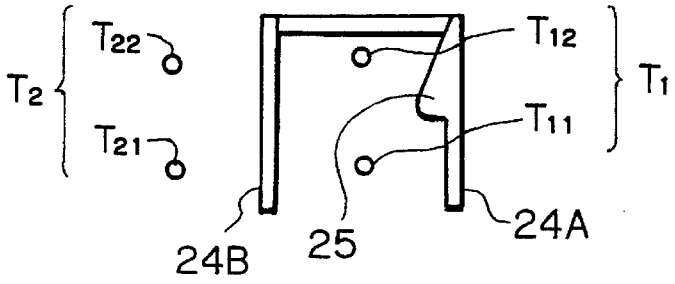
FIGS. 21(A) to 21(D) show the positional relationship between the thread spreading hook and the needle threads when the needles drop.

FIGS. 21(A) to 21(D) show the positional relationship between the position of the thread spreading hook 24 and the needle threads T1 and T2 when the needles 8 and 10 drop. FIG. 21(A) shows a state where the thread spreading hook 24 has just begun to move leftward. At this time, both the right- and left-hand needle threads T1 and T2 are separate from the hook portions 24A and 24B of the thread spreading hook 24.

Figure 21B:
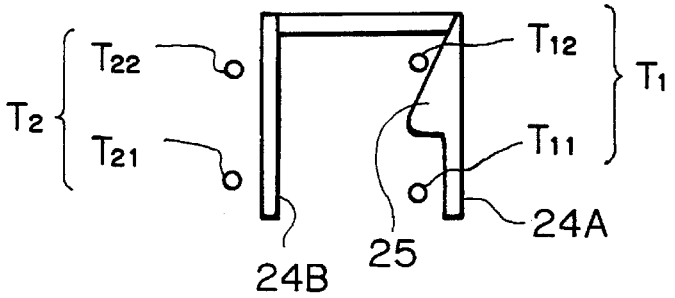
Figure 21C:
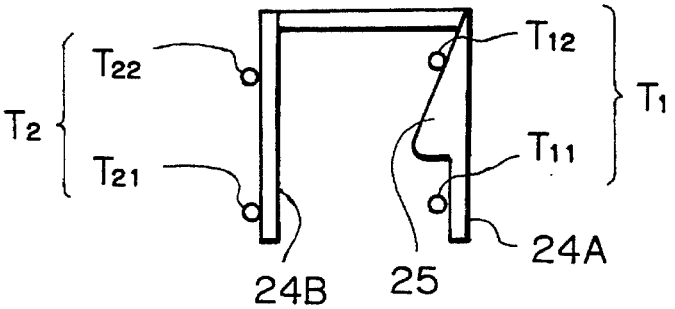
Figure 21D:
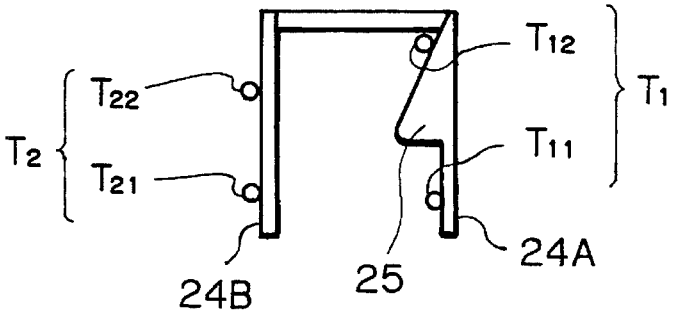

FIG. 21(B) shows a state where the rearward portion T12 of the needle thread T1 is brought into contact with the slant surface of the projection 25 of the right-hand hook portion 24A as a result of the leftward movement of the thread spreading hook 24. FIG. 21(C) shows a state where both the right- and left-hand needle threads T1 and T2 are brought into contact with the hook portions 24A and 24B as a result of further leftward movement of the thread spreading hook 24. FIG. 21(D) shows a state where the thread spreading hook 24 has further moved leftward, and the needles 8 and 10 have dropped into the above-described triangle. At this time, the rearward portion T12 of the right-hand needle thread T1 which is in contact with the slant surface of the projection 25 of the right-hand hook portion 24A slides on the slant surface to move rearwardly (in the fabric feed direction), and thus the angle made by the looper thread R and the lower looper 14 at the section between the distal end of the lower looper 14 and the right-hand hook portion 24A is enlarged, as described above.

Figure 22:
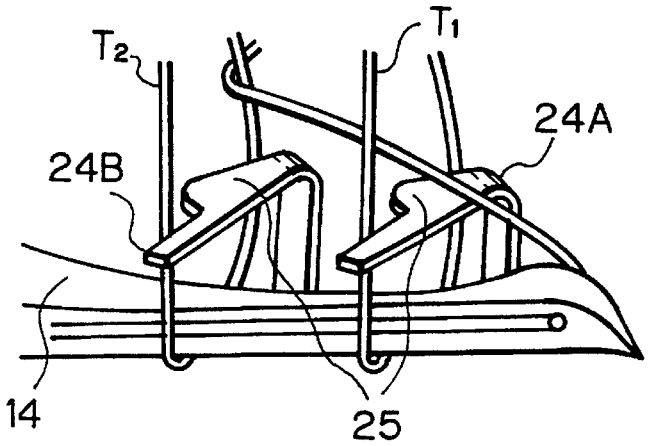
FIG. 22 is a perspective view showing an essential part of a modification of the second embodiment.

FIG. 22 shows a modification of the second embodiment, in which both the hook portions 24A and 24B are formed with projections 25. It should be noted that the same advantageous effect as that in the second embodiment can also be obtained by forming the hook portion 24A in a barlike shape and providing a projection 25 on the hook portion 24B.

Movement of the thread spreading member 24 relative to the needles is illustrated schematically in FIG. 29. The arms 24A and 24B move from a position in which the arm 24B is disposed between the paths of movement of the needles and the arm 24A is offset to the right of the paths of movement of the needles to a position in which the arm 24A is disposed between the paths of movement of the needles and the arm 24B is offset to the left of the paths of movements of the needles.

Third Embodiment

Figure 30A:
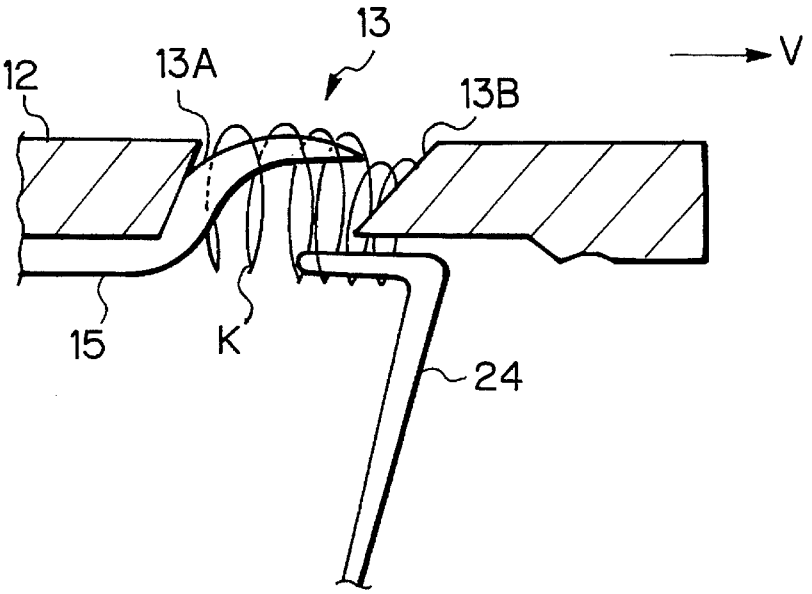
FIGS. 30(A) and 30(B) are sectional and plan views for explanation of a problem arising during over-edge chain stitching when the positional relationship between the needle plate and the thread spreading hook is unfavorable.
Figure 30B:
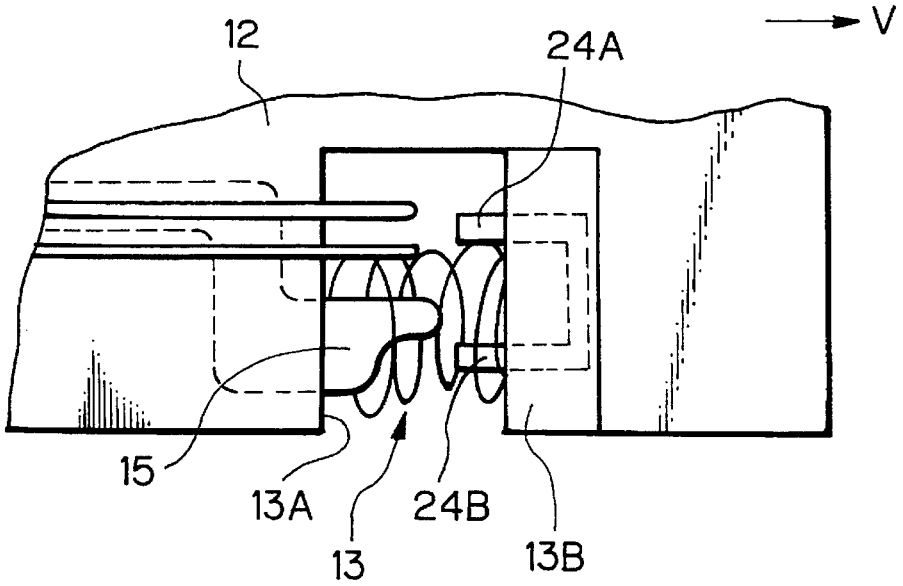
Figure 31A:
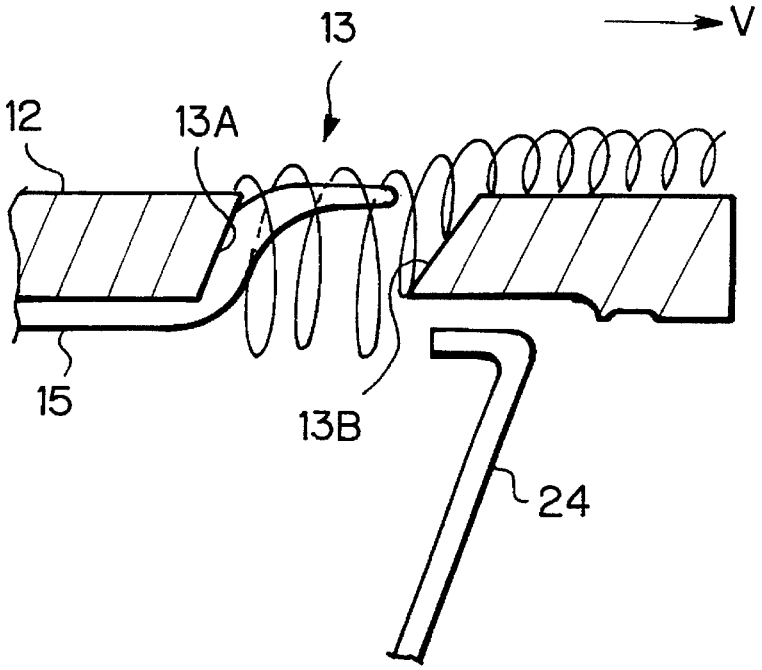
FIGS. 31(A) and 31(B) are sectional and plan views for explanation of the relationship between the needle plate and the thread spreading hook during over-edge chain stitching in the embodiment shown in FIG. 2.
Figure 31B:
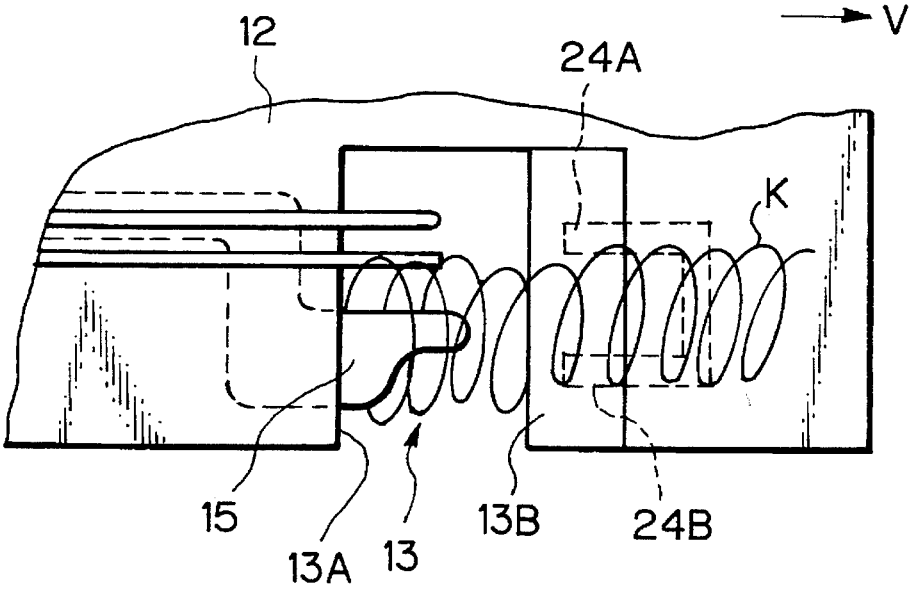
Figure 32:
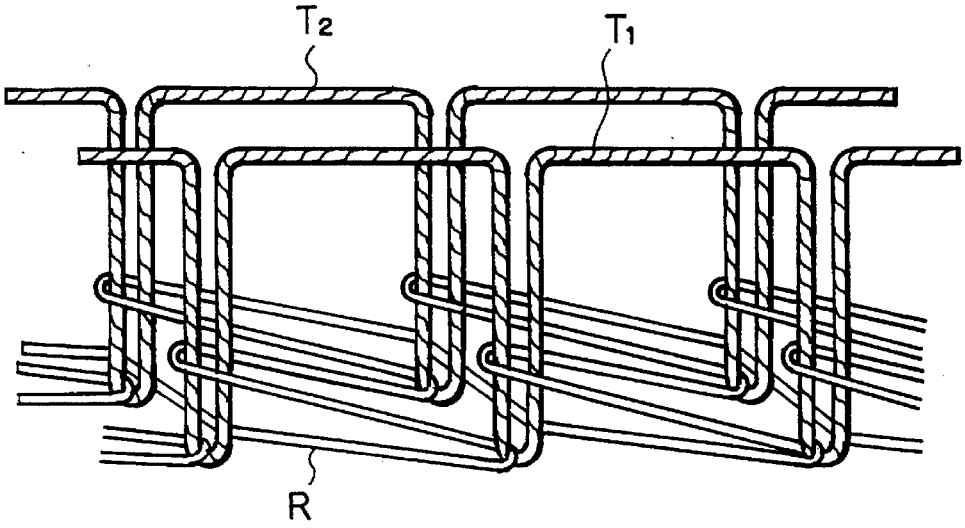
FIG. 32 shows a seam of multi-thread chain stitches.
Figure 33A:
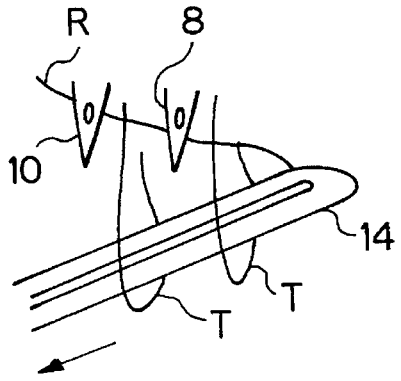
Figure 33B:
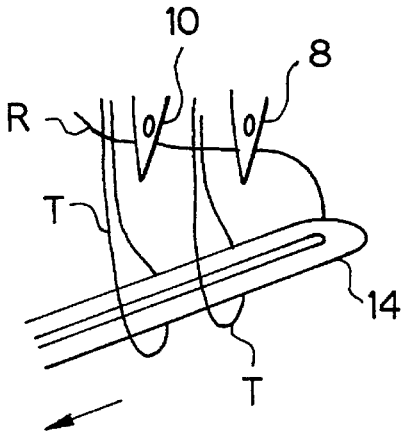

FIGS. 30(A), 30(B), 31(A) and 31(B) show the relationship between the needle plate 12 and the thread spreading hook 24 In a third embodiment of the thread spreading apparatus according to the present invention during over-edge chain stitching. FIGS. 30(A) and 31(A) are sectional views, and FIGS. 30(B) and 31(B) are plan views.

Referring to FIGS. 30(A) and 30(B), the needle plate 12 has an idle chain stitch forming bore 13 and a thread sliding member 15 which is provided at the forward edge 13A of the idle chain stitch forming bore 13. When the forward ends of the hook portions 24A and 24B of the thread spreading hook 24 lie forwardly of the rearward edge 13B of the idle chain stitch forming bore 13 as in the illustrated example, idle chain stitches K are likely to get entangled with the hook portion 24A or 24B when moving in the fabric feed direction shown by V in the figure, causing a sewing failure (see FIG. 30).

Therefore, in this embodiment the thread spreading apparatus is arranged such that the forward ends of the hook portions 24A and 24B of the thread spreading hook 24 lie rearwardly of the idle chain stitch forming bore 13 (that is, rearwardly of the rearward end 13B of the idle chain stitch forming bore 13), as shown in FIGS. 31(A) and 31(B). Accordingly, during over-edge chain stitching, the idle chain stitches K smoothly move in the fabric feed direction without getting entangled with the hook portion 24A or 24B.

It should be noted that since the rest of the thread spreading apparatus in the third embodiment has the same arrangement as that In the first embodiment, illustration thereof is omitted.

Although the thread spreading apparatus for use in an overlock sewing machine according to the present invention has been described above by way of embodiments illustrated in the drawings, it should be noted that the present invention is not necessarily limited to these embodiments, and that various changes and modifications may be imparted thereto. It should also be noted that the present invention is not necessarily limited to overlock sewing machines using two needles, as a matter of course.

According to the present invention, the lower looper for over-edge chain stitching is effectively used to allow the needles to surely descend into a triangle defined by the needle threads, the looper thread and the lower looper, thus enabling multi-thread chain stitching, e.g., cover stitching, to be performed without fail. Further, according to the first embodiment of the present invention, the thread spreading hook is arranged such that the height of the hook portion which is remoter from the distal end of the lower looper is lower than the height of the hook portion which is closer to the distal end of the lower looper. Therefore, the lower looper thread passes over the former hook, and a proper triangle is formed. Thus, no skip stitching occurs.

According to the second embodiment of the present invention, the rearward portion of the needle thread which is closer to the distal end of the lower looper is pushed out in the fabric feed direction by the projection formed on the thread spreading hook. As a result, the angle made by the lower looper thread and the lower looper at the section between the distal end of the lower looper and the hook portion which is closer to the distal end of the lower looper is enlarged, so that the needle which is closer to the distal end of the lower looper can surely drop into the space defined between the lower looper and the looper thread.

According to the third embodiment of the present invention, during over-edge chain stitching, the hook portions of the thread spreading hook lie rearwardly of the idle chain stitch forming bore provided in the needle plate of the sewing machine. Therefore, there is no likelihood of an idle chain stitch getting entangled with either of the hook portions.

What is claimed is:

1. An apparatus for use in an overlock sewing machine to sew material with a looper thread and a needle thread as the material is moved along a feed path, said apparatus comprising:

a lower looper;

first drive means for oscillating said lower looper along the material feed path and for oscillating said lower looper transversely to the material feed path during operation of the sewing machine;

thread positioning means having a thread engaging surface for positioning the needle thread relative to the looper thread and said lower looper to at least partially define an area into which a needle is movable; and second drive means for oscillating said thread positioning means along the material feed path and for oscillating said thread positioning means transversely to the material feed path.

2. An apparatus as set forth in claim 1 wherein said first drive means includes a lower looper drive shaft which is connected with said lower looper, said second drive means including means for transmitting force from said lower looper drive shaft to said thread positioning means to oscillate said thread positioning means along the material feed path and to oscillate said thread positioning means transversely to the material feed path during oscillation of said lower looper along the material feed path and oscillation of said lower looper transversely to the material feed path.

3. An apparatus as set forth in claim 1 wherein said first drive means includes a lower looper drive shaft which is connected with said lower looper, said second drive means including a cam connected with said lower looper drive shaft and force transmitting means for transmitting force from said cam to said thread positioning means to move said thread positioning means relative to the material feed path.

4. An apparatus as set froth in claim 1 further including means for supporting said thread positioning means for pivotal movement about an axis which extends transversely to the material feed path and is located along the material feed path at a location which is ahead of a location where said lower looper is located along the material feed path.

5. An apparatus as set forth in claim 1 wherein said thread engaging surface on said thread positioning means is moved along the material feed path by said second drive means in the direction of movement of the material along the material feed path to push a portion of the needle thread away from said lower looper and enlarge the area into which the needle is movable.

6. An apparatus as set forth in claim 1 wherein said thread positioning means includes an arm which extends into the area defined by the needle thread, looper thread and said lower looper and into which the needle is movable, said arm being movable away from said lower looper by said second drive means to increase the area defined by the needle thread, looper thread and said lower looper to thereby increase the area into which the needle is movable.

7. An apparatus as set forth in claim 1 wherein said first drive means includes a lower looper drive shaft which is connected with said lower looper, said second drive means includes means for transmitting force from said lower looper drive shaft to move said thread positioning means along the material feed path during movement of said lower looper along the material feed path and means for transmitting force from said lower looper drive shaft to move said thread positioning means transversely to the material feed path during movement of said lower looper transversely to the material feed path.

8. An apparatus for use in a sewing machine to form stitches in material with a looper thread and a needle thread, said apparatus comprising a base, a lower looper support connected with said base, said lower looper support being pivotal relative to said base about a first axis, said lower looper support being movable relative to said base along said first axis, a lower looper connected with said lower looper support and movable with said lower looper support relative to said base, a support member connected with said base, said support member being pivotal relative to said base about a second axis and about a third axis which extends transversely to said first and second axes, a thread positioner connected with said support member and movable with said support member relative to said base, and a drive assembly connected with said base and operable to pivot said support member about said second and third axes during movement of said lower looper support relative to said first axis.

9. An apparatus as set forth in claim 8 wherein said thread positioner includes first and second arms which extend transversely to said third axis, said lower looper including a first end portion which is connected with said lower looper support and a second end portion which is spaced from said lower looper support, said first arm of said thread positioner being disposed closer to said second end portion of said lower looper at the beginning of the formation of a stitch in the material by said sewing machine than said second arm of said thread positioner, said first arm of said thread positioner being disposed further from said third axis than said second arm of said thread positioner.

10. An apparatus as set forth in claim 8 wherein said lower looper includes a first end portion which is connected with said lower looper support and a second end portion which is spaced from said lower looper support, said thread positioner including first and second arms which extend transversely to said lower looper, said first arm of said thread positioner being disposed closer to said second end portion of said lower looper at the beginning of the formation of a stitch in the material by said sewing machine than said second arm of said thread positioner, said first arm of said thread positioner having first and second edge portions, said first edge portion of said first arm of said thread positioner being disposed closer to said second arm of said thread positioner than said second edge portion of said first arm of said thread positioner, said first edge portion of said first arm of said thread positioner including a thread engaging edge portion which slopes away from said second arm of said thread positioner and away from an outer end portion of said first arm of said thread positioner, said thread engaging edge portion of said first arm of said thread positioner being engagable with a thread to deflect the engaged thread away from said second end portion of said lower looper.

11. An apparatus as set forth in claim 8 wherein said drive assembly includes a member which transmits force to pivot said support member about said second axis as a function of pivotal movement of said lower looper support about said first axis and a member which transmits force to pivot said support member about said third axis as a function of movement of said lower looper support along said first axis.

12. An apparatus for use in a sewing machine having a plurality of movable needles to sew material with a plurality of needle threads and a looper thread as the material is moved along a feed path, said apparatus comprising a base, a lower looper connected with said base and movable relative to said base during operation of the sewing machine, and a thread positioner connected with said base and movable relative to said base along the material feed path and transversely to the material feed path during operation of the sewing machine, said thread positioner including first and second arms which extend transversely to said lower looper in a direction along the material feed path, said thread positioner being movable in a direction transverse to the material feed path from a first position to a second position, said first arm of said thread positioner being offset to a first side of paths of movement of first and second needles of said plurality of needles when said thread positioner is in the first position, said first arm of said thread positioner being disposed between paths of movement of the first and second needles of said plurality of needles and said second arm being offset to a second side of paths of movement of the first and second needles of said plurality of needles when said thread positioner is in the second position.

13. An apparatus as set forth in claim 12 wherein said first arm of said thread positioner has first and second edge portions, said first edge portion of said first arm of said thread positioner being closer to said second arm of said thread positioner than said second edge portion of said first arm of said thread positioner, said first edge portion of said first arm of said thread positioner being engagable with a first needle thread of said plurality of needle threads during movement of said thread positioner from the first position to the second position, said second arm of said thread positioner having first and second edge portions, said first edge portion of said second arm of said thread positioner being disposed further from said first arm of said thread positioner than said second edge portion of said second arm of said thread positioner, said first edge portion of said second arm of said thread positioner being engagable with a second needle thread of said plurality of needle threads during movement of said thread positioner from the first position to the second position.

14. An apparatus as set forth in claim 13 wherein said first edge portion of said first arm of said thread positioner has a sloping portion which slopes away from an outer end of said first arm of said thread positioner and which slopes away from said second arm of said thread positioner to enable said first arm of said thread positioner to apply force against a portion of said first needle thread urging said portion of said first needle thread away from said lower looper during movement of said thread positioner from the first position to the second position.

15. An apparatus as set forth in claim 12 wherein said first arm of said thread positioner is spaced a first distance from the material feed path and said second arm is spaced a second distance from the material feed path when said first and second arms of said thread positioner are in said second position, said second distance being greater than said first distance.

16. An apparatus as set forth in claim 12 wherein said second arm of said thread positioner is disposed between paths of movement of the first and second needles of said plurality of needles when said plurality of needles when said thread positioner is in the first position.

17. An apparatus as set forth in claim 12 wherein said first and second arms of said thread positioner have outer end portions, said outer end portions of said first and second arms of said thread positioner being offset from a plane extending through central axes of the first and second needles of said plurality of needles in a direction opposite to a direction in which the material is moved along the material feed path when said thread positioner is in the second position, said thread positioner being movable along the material feed path from the second position to a third position in which said outer end portions of said first and second arms of said thread positioner are offset from the plane extending through central axes of the first and second needles in a direction which is the same as the direction in which the material is moved along the material feed path.

18. An apparatus as set forth in claim 12 further including first drive means for moving said lower looper along the material feed path and transversely to the material feed path and second drive means for moving said thread positioner along the material feed path at a rate which is a function of a rate of movement of said lower looper along the material feed path and for moving said thread positioner transversely to the material feed path at a rate which is a function of a rate of movement of said lower looper transversely to the material feed path.

19. An apparatus for use in a sewing machine having a plurality of needles which are movable from a position above a needle plate to a position extending through a needle plate to sew material with a plurality of needle threads and a looper thread as the material is moved along the needle plate, said apparatus comprising a base, a lower looper connected with said base and movable relative to said base and needle plate during operation of the sewing machine, and a thread positioner connected with said base and movable relative to said base and needle plate during operation of the sewing machine, said thread positioner including first and second arms, said first arm of said thread positioner being disposed closer to the needle plate than said second arm of said thread positioner when the plurality of needles extend through the needle plate, said first arm of said thread positioner being engagable with the looper thread to position the looper thread relatively close to the needle plate.

20. An apparatus as set forth in claim 19 wherein a first one of the needles of the plurality of needles is offset from said first arm of said thread positioner in a direction away from said second arm of said thread positioner and a second one of the needles of the plurality of needles extends between said first and second arms of said thread positioner when the plurality of needles extend through the needle plate.

21. An apparatus as set forth in claim 19 wherein said first arm of said thread positioner has a first edge portion which engages the first needle thread and a second edge portion opposite from said first edge portion, one of the needles of the plurality of needles extending into a generally triangular area offset to a side of said first arm of said thread positioner opposite from said second arm of said thread positioner and at least partially defined by said lower looper, looper thread and second edge portion of said first one of said arms of said thread positioner when the plurality of needles extend through the needle plate.

22. An apparatus as set forth in claim 19 further including drive means connected with said base and said thread positioner for moving said thread positioner relative to said base along a path of movement of the material along the needle plate and transversely to the path of movement of the material along the needle plate.

23. An apparatus as set forth in claim 19 wherein said lower looper has an end portion, said first arm of said thread positioner being disposed closer to said end portion of said lower looper when the plurality of needles extend through the needle plate than said second arm of said thread positioner.

24. An apparatus for use in a sewing machine having a plurality of needles which are movable to sew material with a plurality of needle threads and a looper thread as the material is moved along a needle plate, said apparatus comprising a base, a lower looper connected with said base and movable relative to said base and needle plate during operation of the sewing machine, and a thread positioner connected with said base and movable relative to said base and needle plate during operation of the sewing machine, said thread positioner including first and second arms, said first arm of said thread positioner having first and second edge portions, said first edge portion of said first arm of said thread positioner being disposed closer to said second arm of said thread positioner than said second edge portion of said first arm of said thread positioner, said first edge portion of said first arm of said thread positioner including a sloping portion which is engagable with one of the needle threads to deflect a portion of the one of the needle threads away from said lower looper, said sloping portion of said first arm of said thread positioner slopes away from an outer end portion of said first arm of said thread positioner and away from said second arm of said thread positioner.

25. An apparatus as set forth in claim 24 wherein the plurality of needles are movable from a position above the needle plate to a position extending through the needle plate during sewing of the material, said first arm of said thread positioner being engagable with said looper thread to deflect a portion of the looper thread away from said lower looper, one of the needles of the plurality of needles extending into a generally triangular area offset to a side of said first arm of said thread positioner opposite from said second arm of said thread positioner and at least partially defined by said lower looper, looper thread and second edge portion of said first one of said arms of said thread positioner when the plurality of needles extend through the needle plate.

26. An apparatus as set forth in claim 24 further including drive means connected with said base and said thread positioner for moving said thread positioner relative to said base along a path of movement of the material along the needle plate and transversely to the path of movement of the material along the needle plate.

27. An apparatus as set forth in claim 24 wherein a first one of the needles of the plurality of needles is offset from said first arm of said thread positioner in a direction away from said second arm of said thread positioner and a second one of the needles of the plurality of needles extends between said first and second arms of said thread positioner when the plurality of needles extend through the needle plate during sewing of the material.

28. An apparatus as set forth in claim 24 wherein said first arm of said thread positioner is disposed closer to the needle plate than said second arm of said thread positioner when the plurality of needles extend through the needle plate during sewing of the material, said first arm of said thread positioner being engagable with the looper thread to position the looper thread relatively close to the needle plate.

* * * * *

UNITED STATES PATENT AND TRADEMARK OFFICE

CERTIFICATE OF CORRECTION

PATENT NO. : 5,467,725
DATED : November 21, 1995
INVENTOR(S) : Shuji Fujita, Yasushi Baba, Hitoshi Itoh, Shiro Satoma It is certified that error appears in the above-indentified patent and that said Letters Patent is hereby corrected as shown below:

Column 14, line 34, change "froth" to --forth--.

Signed and Sealed this

Thirteenth Day of August, 1996

*Attest:*

*Attesting Officer*

BRUCE LEHMAN

*Commissioner of Patents and Trademarks*